US006082265A

United States Patent [19]

Sakamoto et al.

[11] Patent Number: 6,082,265

[45] Date of Patent: Jul. 4, 2000

[54] ELECTRONIC DELAY DETONATOR

[75] Inventors: Midori Sakamoto; Masaaki Nishi; Kazuhiro Kurogi, all of Nobeoka, Japan

[73] Assignee: Asahi Kasei Kogyo Kabushiki Kaisha, Osaka, Japan

[21] Appl. No.: 09/000,488

[22] PCT Filed: Jul. 24, 1996

[86] PCT No.: PCT/JP96/02066

§ 371 Date: Jan. 23, 1998

§ 102(e) Date: Jan. 23, 1998

[87] PCT Pub. No.: WO97/05446

PCT Pub. Date: Feb. 13, 1997

[30] Foreign Application Priority Data

Jul. 26, 1995 [JP] Japan ..... 7-190615
Dec. 22, 1995 [JP] Japan ..... 7-335524

[51] Int. Cl.[7] ..... F23Q 7/02

[52] U.S. Cl. ..... 102/206

[58] Field of Search ..... 102/206, 215, 102/217, 216; 361/247, 249

[56] References Cited

U.S. PATENT DOCUMENTS

| | | | |
|---|---|---|---|
| 4,405,875 | 9/1983 | Nagai | 310/344 |
| 4,445,435 | 5/1984 | Oswald . | |
| 4,712,477 | 12/1987 | Aikou et al. | 102/206 |
| 4,825,765 | 5/1989 | Ochi et al. | 102/206 |
| 4,893,564 | 1/1990 | Ochi et al. | 102/206 |
| 4,920,884 | 5/1990 | Haglund et al. | 102/215 |
| 4,984,519 | 1/1991 | Ochi et al. | 102/217 |
| 5,202,532 | 4/1993 | Haglund et al. | 102/215 |
| 5,295,438 | 3/1994 | Hill et al. | 102/217 |
| 5,363,765 | 11/1994 | Aikou et al. | 102/215 |
| 5,435,248 | 7/1995 | Rode et al. | 102/206 |
| 5,602,360 | 2/1997 | Sakamoto et al. | 102/220 |
| 5,602,713 | 2/1997 | Kurogi et al. | 102/217 |
| 5,912,428 | 6/1999 | Patti | 102/215 |

FOREIGN PATENT DOCUMENTS

| | | |
|---|---|---|
| 0 212 111 | 3/1987 | European Pat. Off. . |
| 39 42 842 | 6/1991 | Germany . |
| 90 10 344 | 12/1990 | South Africa . |
| 95/04253 | 2/1995 | WIPO . |
| 95/33178 | 12/1995 | WIPO . |

OTHER PUBLICATIONS

J. Azuwarudo, "Electronic Detonator", Abstract of JP 57–035298, Feb. 25, 1982.

A. Kenichi et al., "Electronic Delay Electric Detonator", Abstract of JP 05–079797, Mar. 30, 1993.

A. Kenichi et al., "Shot–Firing", Abstract of JP 01 285800, Nov. 16, 1989.

S. Daamuberui et al., "Triggering Device", Abstract of JP 63–290398, Nov. 28, 1988.

A. Kenichi et al., "Electrical Delay–Action Detonator", Abstract of JP 62–158999, (1987).

(List continued on next page.)

*Primary Examiner*—Charles T. Jordan
*Assistant Examiner*—Denise J Buckley
*Attorney, Agent, or Firm*—Finnegan, Henderson, Farabow, Garrett & Dunner, L.L.P.

[57] ABSTRACT

An electronic delay detonator comprises an electronic timer (100) and an electric detonator (200) fired by ignition of an ignition element. The timer includes an energy charging circuit (120) for storing electrical energy supplied from a power supply, a delay circuit (30) for counting a time period by using the electrical energy stored in the energy charging circuit to thereby output a trigger signal, and a switching circuit (140) for supplying the electrical energy stored in the energy charging circuit to the ignition element in response to the trigger signal. To an impact externally applied to the electronic delay detonator, a lower limit of an impact value in an induced detonation range of the electric detonator substantially overlaps with an upper limit of an impact value in a range in which the electronic timer is operable. Thus, no explosive remains misfired even in adverse use environments. When the damage of the quartz oscillator (131) is detected, the electric detonation is fired in response to the detected signal.

27 Claims, 17 Drawing Sheets

OTHER PUBLICATIONS

M. Kimisuke, "Delay Pulse Generator for Ignition", Abstract of JP 58–83200, (1983).

Abstract of JP 1–31398, (1989).

"IC Application Circuit Sets" published by Chuang Hwa Technology Book Company in Oct. 1990.

AT TYPE

E TYPE

TUNING FORK TYPE

ELECTRONIC DELAY DETONATOR

TECHNICAL FIELD

The present invention relates to an electronic delay detonator for controlling an ignition delay time with high accuracy in blasting work for charging a plurality of explosives into an object of destruction (such as rock or a building) and sequentially detonating them, and particularly to an electronic delay detonator which is free of a misfire range and thereby provides extremely high safety.

BACKGROUND ART

An electronic delay detonator has heretofore been known which allows an energy charging circuit to store therein electrical energy supplied from a blasting machine, is activated in response to the stored electrical energy and performs switching after a lapse of a desired delay time.

Prior arts of the electronic delay detonator have been proposed as examples as follows:

(i) A technique for controlling an ignition time by using a charge time constant of an RC circuit as a reference is disclosed in Japanese Patent Application Laid-Open Nos. 83200/1983, 91799/1987, etc.

(ii) A technique for controlling an ignition time with extremely high time accuracy by using a characteristic frequency of a solid oscillator such as a quartz oscillator as a reference is disclosed in U.S. Pat. No. 4,445,435, DE 3,942,842, Japanese Patent Application Laid-Open No. 79797/1993, WO95/04253, etc.

In general, each of these electronic delay detonators comprises an electronic timer 100 supplied with electrical energy from a blasting machine 10 and an electric detonator 200 as shown in FIG. 1. The electronic timer 100 includes an energy charging circuit 120, a delay circuit 30 and an electronic switching circuit 140. In blasting, the electronic timer 100 is supplied with the electrical energy from the blasting machine 10, stores the electrical energy in the energy charging circuit 120, and then, drives the delay circuit 30 based on the electrical energy stored in the energy charging circuit 120 after completion of the supply of the electrical energy from the blasting machine 10. After a predetermined delay time has elapsed, the delay circuit 30 closes the electronic switching circuit 140 so that the electrical energy stored in the energy charging circuit 120 is supplied to the electric detonator 200, whereby the electric detonator 200 is fired.

Thus, when the electronic timer 100 including the delay circuit 30 is deactivated for some causes, generally, damage by an impact, the electric detonator 200 is not fired. Therefore, structures for protecting the electronic timer against the impact grow in importance. As these techniques, there have heretofore been known ones disclosed in Japanese Patent Application Laid-Open Nos. 35298/1982, 290398/1988 and 158999/1987, Japanese Utility Model Application Laid-Open No. 31398/1989, etc., for example. The following structures have been disclosed in these gazettes.

(a) A structure in which an electronic timer is inserted into a housing of an electric detonator and sealed with epoxy or a composition of epoxy with elastomer;

(b) A structure cast-sealed with a thermoplastic resin such as polystyrene or polyethylene;

(c) A structure in which a substrate is fixed to a case by an O-ring; and (d) A structure in which an electronic timer is directly inserted into a plastic case and a vacant space is defined between the case and the electronic timer.

Major uses of the aforementioned electronic delay detonator are for reduction in ground vibration or noise produced due to blasting. As described in Japanese Patent Application Laid-Open No. 285800/1989, it is however necessary to meet the following condition in respect of the accuracy of an ignition time with a view toward achieving these objects:

$$t/\sigma \geqq 10$$

where t: ignition time interval

σ: standard deviation of variation in ignition time interval

It is desirable that since the ignition time interval t is often set to within 10 ms, the standard deviation σ of the ignition time interval should be limited so as to fall within at most ±1 ms.

In actual blasting work, a plurality of explosives inserted in electronic delay detonators are used and charged into their corresponding explosive boreholes defined therein based on predetermined blasting patterns. Thereafter, the explosives are successively detonated to fracture such as rock with predetermined time differences. Therefore, these explosive boreholes are expected to be adjacent to each other at a much shorter distance according to the blasting patterns. It is also apprehended that the explosives and electronic delay detonators will be subjected to a violent blasting shock of the adjacent boreholes before their own firing. Particularly when the blasting work is carried out for tunnel digging, the bootlegs of the adjacent boreholes are defined so as to be close to each other to improve fracturing effects, and the interval between the bootlegs often reaches 20 cm or less in the case of a fracturing method called "V cut".

Further, the following various shock modes are considered as examples of explosive shocks that the electronic delay detonator undergoes before its own firing.

(1) A mode where the electronic delay detonator is subjected to compression in all the directions through a spring water expected to be produced at a blasting site;

(2) A mode where the electronic delay detonator is expelled by vibrations in an elastic range of rock so that displacement acceleration is produced;

(3) A mode where explosive gas enters through a crack of rock so that compression applied from one direction or displacement acceleration is produced in the electronic delay detonator; and (4) A mode where the rock is displaced by destruction so that the electronic delay detonator is subjected to compression by the displaced rock.

The degree of each shock differs according to the quantity of explosives in the source of explosion and the condition of the rock. However, the degree of the shock is considered to reach pressures of 30 MPa to 70 MPa or shock acceleration of several tens of thousands of G to several hundreds of thousands of G at a distance of about 20 cm from exploding site.

In this case, the electronic delay detonator will be subjected to an extremely large explosive shock and hence the conventional techniques referred to above have much difficulty in completely eliminating misfire of an electric detonator.

In contrast to this, since all the ignition charges of conventional individual electric detonators using not the electronic timer but delay charges, are simultaneously fired even when the conventional electric detonators are subjected to the aforementioned shocks, the detonators are little misfired even if a detonation force of each electric detonator is reduced (imperfectly detonated). Further, when the shocks that such electric detonators undergo, are so violent, the ignition charges, primary explosives or base charges are subjected to compression or impact so that the electric detonators are often sympathetically detonated prior to the detonation using the delay charges (see FIG. 2A).

In the conventional electronic delay detonator using the electronic timer, however, when the electronic delay detonator is subjected to the violent explosive shock, i.e., the compression or displacement acceleration, there exists a range in which the electronic timer produces damage under an impact force having a level lower than an impact level at which the electric detonator reaches the sympathetic detonation. Further, a misfire range in which the electric detonator is not fired, exists between a range in which the electric detonator reaches the sympathetic detonation and a range in which the electronic timer is operable.

Particularly in the case of an electronic delay detonator having a high-accuracy electronic timer using a quartz oscillator, a crystal rod is bent due to displacement acceleration. With marked bending, the crystal rod collides with a case cylinder, so that the crystal may cause damage.

Thus, the quartz oscillator becomes a big factor that lowers an impact resisting level under which the quartz oscillator avoids damage as compared with other parts, and reduces the operating range of the electronic timer to thereby cause misfiring (see FIG. 2B).

According to the already-described WO95/04253, the technique has been proposed that an RC oscillator circuit is activated in cooperation with a quarts oscillator circuit, and the operation of the quartz oscillator circuit is changed-to that of the RC oscillator circuit when the quartz oscillator fails. However, the proposed technique is accompanied by problems that when a hybrid integrated circuit (HIC) including the RC oscillator circuit is subjected to such a shock that will cause damage, a misfire range cannot be avoided from occurring and the accuracy of operation subsequent to the substitution of the RC oscillator circuit is reduced.

DISCLOSURE OF THE INVENTION

In order to solve the above problems, it is an object of the present invention to permit controlled blasting based on a high-accuracy ignition time, which takes advantage of properties of an electronic timer by using a quartz oscillator or ceramic oscillator as a reference in normal use environment of blasting work, and to ensure the operation of the high-accuracy electronic timer even after a quartz oscillator breaks in adverse use environments and also to prevent misfire range remaining.

When the mode of an ignition shock applied to an electronic delay detonator corresponds to, for example, a case in which rock is displaced by destruction so that the detonator undergoes compression, it is expected to undergo extremely big impact pressure. It is thus considered that the electronic delay detonator itself would be crushed. According to the present invention, however, detection of the damage of the quartz oscillator is made during the difference in time developed between the damage of the quartz oscillator produced in response to the shock and the compression of the electronic delay detonator by the rock, whereby an electric detonator is constructed so as to be fired in response to the detected signal. Thus, the problem concerned with the misfire remains can be solved.

In a first aspect of the present invention, there is provided an electronic delay detonator comprising:

an energy charging circuit for storing electrical energy supplied from a power supply;

a delay circuit for determining a time period by using the electrical energy stored in the energy charging circuit to thereby output a trigger signal; and a first switching circuit for supplying the electrical energy stored in the energy charging circuit to the ignition element in response to the trigger signal, wherein to an impact externally applied to the electronic delay detonator, a lower limit of an impact value in an induced detonation range of the electric detonator substantially overlaps with an upper limit of an impact value in a range in which the electronic timer is operable.

The induced detonation range described herein shows a range including at least one of the conventional sympathetic detonation and a self detonation to be described as follows. Namely, the induced detonation range corresponds to a range which includes either one of a so-called sympathetic detonation in which the detonator is fired owing to the external shock, or a self detonation in which the detonator is forcibly fired upon detecting internally the malfunctioning of the electronic timer. Even in the case of the firing due to any cause, the detonator is fired irrespective of the counting of the electronic timer.

In a second aspect of the present invention, there is provided an electronic delay detonator comprising:

an energy charging circuit for storing electrical energy supplied from a power supply;

a delay circuit for determining a time period by using the electrical energy stored in the energy charging circuit to thereby output a trigger signal; and a first switching circuit for supplying the electrical energy stored in the energy charging circuit to the ignition element in response to the trigger signal, wherein the delay circuit comprises:

a first oscillator circuit using a characteristic frequency of a quartz oscillator as a reference;

a second oscillator circuit having impact resisting properties;

a count period producing circuit for producing one or a plurality of count periods by using pulses of the second oscillator circuit so that a count period coincides with a reference period produced by pulses of the first oscillator circuit; and a trigger signal generating circuit for generating and outputting the trigger signal based on the count period.

In a third aspect of the present invention, there is provided an electronic delay detonator comprising:

an energy charging circuit for storing electrical energy supplied from a power supply;

a delay circuit for determining a time period by using the electrical energy stored in the energy charging circuit to thereby output a trigger signal; and a first switching circuit for supplying the electrical energy stored in the energy charging circuit to the ignition element in response to the trigger signal, wherein the electronic timer comprises:

a malfunction detecting circuit for detecting a malfunction of circuit elements, the malfunction occurring when the circuit element is subjected to an explosive shock, and the malfunction detecting circuit outputting a malfunction detecting signal;

a forced trigger circuit for outputting a forced trigger signal in response to the malfunction detecting signal; and a second switching circuit for supplying the ignition element with the electrical energy stored in the energy charging circuit in response to the forced trigger signal.

In a fourth aspect of the present invention, there is provided an electronic delay detonator comprising:

an energy charging circuit for storing electrical energy supplied from a power supply;

a delay circuit for determining a time period by using the electrical energy stored in the energy charging circuit to thereby output a trigger signal; and a first switching circuit for supplying the electrical energy stored in the energy charging circuit to the ignition element in response to the trigger signal, wherein the electronic timer is housed within a cylinder having impact resisting properties, and a space defined between the electronic timer and a wall of the cylinder is filled with a viscoelasticity material.

In a fifth aspect of the present invention, there is provided an electronic delay detonator comprising:

an energy charging circuit for storing electrical energy supplied from a power supply;

a delay circuit for determining a time period by using the electrical energy stored in the energy charging circuit to thereby output a trigger signal; and a first switching circuit for supplying the electrical energy stored in the energy charging circuit to the ignition element in response to the trigger signal, wherein the electronic timer is housed within a cylinder having impact resisting properties, only a periphery of the energy charging circuit is covered with one of a foamed resin and a gel-like substance material whose needle penetration ranges from 10 to 100, and an overall space defined between the electronic timer and a wall of the cylinder is filled with a viscoelasticity material.

According to the present invention, the delay circuit can perform a counting operation using a characteristic frequency of a quartz oscillator as a reference, a length T of a crystal of the quartz oscillator can be in the range of 2.0 mm to 3.5 mm, and a ratio T/A of the length T to a width A of the crystal is can be the range of 2.0 to 3.5.

According to the present invention, the trigger signal generating circuit can comprise:

a reference pulse generator circuit for generating a reference pulse signal based on the count period; and a main counter circuit for outputting the trigger signal when the main counter circuit has counted the reference pulse signal by preset times.

According to the present invention, the count period producing circuit can comprise:

a circuit for generating a count period creation start signal and a count period creation end signal when the generating circuit has counted the pulse outputted from the first oscillator circuit by first and second preset times; and a periodic counting data circuit for starting the counting of the pulse outputted from the second oscillator circuit upon receiving the count period creation start signal, terminating the counting of the output pulse of the second oscillator circuit upon receiving the count period creation end signal, and then fixing the result of the counting as a count period.

According to the present invention, the count period producing circuit can comprise:

means for producing, as the reference period, first to nth (≧2) fixed time intervals whose minimum fixed time interval is equal to the minimum ignition time interval and which are predetermined and different from each other, using the pulse generated by the first oscillator circuit as a reference, and means for producing and latching the first to nth (≧2) count periods in accordance with the first to nth fixed time intervals using a pulse train generated by the second oscillator circuit as a reference, and wherein the trigger signal generating circuit comprises:

first to nth separating means for respectively separating predetermined delay time intervals in reverse order by predetermined times in accordance with the first through nth count periods using a pulse train generated by the second oscillator circuit as a reference; and means for generating the trigger signal when the predetermined delay time intervals have been separated by the predetermined number of times at the first count period by the first separating means.

According to the present invention, the first to nth fixed time interval producing means can comprise:

a first fixed time interval producing counter for counting a pulse train generated from the first oscillator circuit during the first fixed time interval; and second through nth fixed time interval producing counters for respectively counting the pulse train generated from the first oscillator circuit during the second through nth fixed time intervals.

According to the present invention, the first to nth separating means can respectively comprise:

latch circuits for latching the first to nth fixed time intervals;

first to nth separating counters which is set with first to nth fixed time intervals latched in the latch circuits individually, the first to nth separating counters respectively counting the pulse train generated by the second oscillator circuit and outputting pulse signals each count-up time; and first to nth counters for counting pulses outputted from the first to nth separating counters each time the first to nth separating counters count up, the first to nth counters being activated in serial so as to release the (m−1) th counter from the reset state in response to the count-up of the mth (≦n ) counter.

According to the present invention, a space length can be provided between an ignition charge layer ignited by the ignition element and a primary explosive layer, the space length ranging from 4 mm to 14 mm.

According to the present invention, the circuit for detecting a malfunction of the energy charging circuit can detect a voltage value of the energy charging circuit after completion of the charging of the energy charging circuit, and can detect that the voltage value has reached the minimum firing voltage for firing the electric detonator.

According to the present invention, the circuit for detecting a malfunction of the energy charging circuit can detect, after completion of the charging of the energy charging circuit, that a value of a discharge voltage vs. time gradient of the energy charging circuit is larger than a specific value.

According to the present invention, the viscoelasticity material can have a hardness ranging from 10 to 90 under JIS Shore A durometer.

According to the present invention can be characterized in that the cylinder is covered with plastic case.

According to the present invention can be characterized in that the electric detonator shares an axis together with a cylinder in which the electronic timer is housed, and has a shape which is projected from the cylinder.

The aforementioned aspects or embodiments of present invention can be conceived singly or in combination according to the intended purposes.

BRIEF DESCRIPTION OF THE DRAWINGS

Preferred embodiments of the invention will now be described by way of examples, with reference to the accompanying drawings, wherein:

FIGS. 4A and 4B show an external appearance of an example of a module having an IC timer shown in FIG. 3, which has actually been mounted on a substrate, wherein FIG. 4A is a side view and FIG. 4B is a plan view, respectively;

FIGS. 6A and 6B show an external appearance of another example of the module having the IC timer of FIG. 3, which has been actually mounted on the substrate (printed circuit board), wherein FIG. 6A is a plan view and FIG. 6B is a side view, respectively;

FIGS. 8A, 8B and 8C respectively show external appearances of the shapes of crystals of quartz oscillators each employed in the electronic timer applied to the present invention, wherein FIG. 8A is a perspective view showing the shape of a crystal of an AT-type quartz oscillator, FIG. 8B is a perspective view illustrating the shape of a crystal of an E-type quartz oscillator and FIG. 8C is a perspective view depicting the shape of a crystal of a tuning fork type quartz oscillator;

BEST MODES FOR CARRYING OUT THE INVENTION

First Basic Mode of Present Invention

Figure 1:
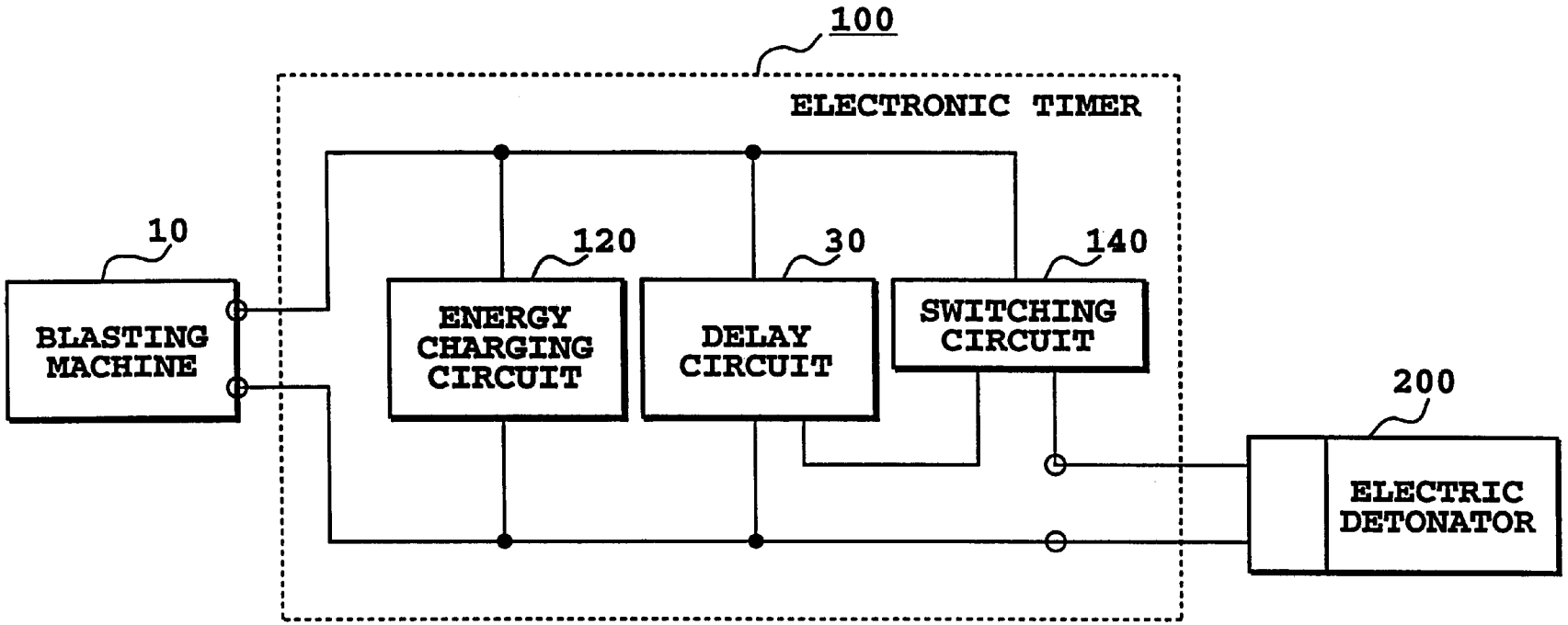
FIG. 1 PRIOR ART
FIG. 1 is a circuit diagram schematically showing a circuit configuration of a general electronic delay detonator.

In the first basic mode according to the present invention, the upper limit of an impact value in a range in which an electronic timer of an electronic delay detonator is operable, is enlarged to the neighborhood of the lower limit of an impact value in an induced detonation range of an electric detonator or until it overlaps with the lower limit thereof, thereby making it possible for the electronic timer to operate to fire the electric detonator under wider range of impact (refer to FIG. 2C-(1)).

When the upper limit of the impact value in the range in which the electronic timer to start counting based on a characteristic frequency of a quartz oscillator as a reference is operable, is increased to reach the lower limit of the impact value in the induced detonation range of the electric detonator, thereby allowing firing of the electric detonator, a misfire range can be eliminated without impairing the accuracy of the counting.

As specific means for enlarging the operating range of the electronic timer, there may be mentioned the following ones.

(1) First, the electronic timer is accommodated in a case which is undeformable or little deformable against the pressure.

Although the strength of the case against external pressure differs according to the quality of a material of a cylinder constituting the case or the outer diameter and shape thereof, the case needs to endure to a range in which a detonator is sympathetically detonated. Therefore, it is essential to design the case so as to endure a hydrostatic pressure of 30 MPa and above. The outer diameter of the case may preferably fall within a range from 10 mm to 30 mm. The thickness of the case needs to fall within a range from 0.5 mm to 2 mm.

The elastic modules of the material used for the case may preferably be at least 10,000 kg/mm$^2$ or above. As the material of the case, there may be mentioned, for example, a metal such as stainless steel, iron, copper, aluminum or brass, or an alloy of these metals, or fibrous glass reinforced plastic (FRP) or the like. The shape of the case may preferably-be cylindrical in terms of processability and uniformity of the material. Further, ribs may more preferably be provided in the circumferential or longitudinal direction of the cylinderical case because of an improvement in resistance.

(2) Next, electronic parts that constitute the electronic timer, are formed integrally, via a fixative or fixing agent, with a substrate to which the parts have been connected by brazing or mechanically:

Since acceleration ranging from several tens of thousands of G to several hundreds of thousands of G is generated in each nearby bore hole as described above, the mere fixing of the electronic parts to the substrate by the method such as brazing might cause the electronic parts to slip away from the substrate due to an impact applied thereto. It is thus necessary to form the electronic parts integrally with the substrate more firmly.

As the fixing agent for integrating the electronic parts with the substrate into one under the above impact, there may be used thermoset resins such as an epoxy resin, an epoxy-acrylate resin, an unsaturated polyester resin, a phenol resin, a melamine resin, a urea resin, an urethane resin and an expanded urethane resin; a silicone elastomer; elastic rubber materials such as silicon rubber and urethane rubber; etc. However, these fixing agents need to have at least a hardness of 10 or more under the JIS shore "A" durometer. This is because when the elements fall into the hardness of less than 10, i.e., a gel-like substance material range for evaluating the hardness in needle penetration, the effect of forming the substrate and the elements into an integral form is weakened so that the elements slip away from the substrate.

(3) Next, the electronic timer is designed so as to be prevented from colliding with the case.

Particularly when the electronic delay detonator is shocked from one direction, the electronic timer comes into collision with the case when the electronic timer is free from the case. Therefore, the electronic timer has an impact about twice as strong as the first impact. It is thus necessary to provide a space filler or loading material between the electronic timer and the case with a view toward preventing the electronic timer from colliding with the case.

Upon selection of the space filler, it is of importance that the filler has a viscoelastic characteristic. Namely, a soft material low in elastic modulus may be used for the filler. When the elastic modulus thereof is large (100 kg/mm$^2$ or above), the impact applied to the cylinder is transferred directly to the electronic parts as it is so that the elements are sometimes brought to damage. Therefore, the material having such a high elastic modulus is not preferable. The hardness may preferably be a hardness of 90 or less under the JIS Shore "A" durometer, more preferably, a hardness range from 10 to 90 under the JIS (Japanese Industrial Standards) Shore "A" durometer. A preferred material may be, for example, silicone rubber, urethane rubber or the like.

(4) Next, the electronic timer is accommodated within the cylinder having impact resisting properties so that only the surroundings of particular parts of the electronic timer are a low-density area for protecting the particular parts.

When the blasting bore hole in which the explosive inserted in the electronic delay detonator is placed, is of a hydropore as described above, the electronic delay detonator is brought into a state of being covered with an incompressible, homogeneous medium, i.e., water, so that the electronic delay detonator is subjected to an underwater shock wave over its entire periphery. Since a particularly-sharpened wave of the underwater shock penetrate the case and the space filler so as to reach the electronic parts, the electronic parts sensitive to the impact are affected by the underwater shock wave.

In the case of the electronic timer employed in one basic mode according to the present invention, the electronic parts most susceptible to the underwater shock wave may be an energy capacitor and a quartz oscillator which constitute an energy charging circuit. The quartz oscillator varies in shock destruction level according to its vibration mode but is structurally low in impact-proofness as compared with other electronic elements. When a CR circuit is used in combination with the quartz oscillator and is used as a reference for counting a time period, the accuracy of counting is reduced as compared with a delay circuit in which only the quartz oscillator is set as the reference for counting a time period. It is however not impossible to improve the impact proof against the electronic detonator to some extent.

As the type of capacitor, an electrolytic capacitor is most susceptible to the impact. When a strong impact is applied to the electrolytic capacitor, a phenomenon occurs in which an electrical charge stored therein is abnormally discharged. When an energy capacitor is composed of such a capacitor, predetermined energy required to fire the detonator should be held in the energy capacitor until the termination of counting a time period by the delay circuit. Thus, a misfire will occur when the electrical charge becomes lost due to the abnormal discharge before completion of the counting.

It is thus more important to improve the impact resisting properties of the above capacitor. It is therefore necessary to suppress the shock wave which reaches the capacitor. A low-density area is formed around the capacitor as means for suppressing the shock wave. Described specifically, it is preferable that the capacitor is covered with, for example, one obtained by winding a foamed resin around the capacitor, one obtained by providing a substance material layer high in viscosity such as a gel-like substance material around the capacitor so as to form double charged layers, or one obtained by adding a foaming agent directly to a viscoelasticity material. When a capacitor having an outside shape of 10ø–16 mmL, for example, is used, it is preferable that only an outer cylinder of the capacitor is covered with a protective material formed in thickness ranging from 0.5 mm to 5 mm (preferably 2 mm to 4 mm) and in length ranging from about 10 mm to 15 mm. The foamed resin used as the protective material may be foamed polyethylene, expanded urethane or the like. An expansion ratio of the foamed resin may preferably range from several times to several tens of times. Further, the silicone gel, urethane gel or the like described above is suitable as the gel-like substance material used as the protective material, and a range of the needle-penetration is suitable from 10 to 100. The needle penetration is defined as a consistency test method according to JISK-2220 of JIS, and a needle having a total weight of 9.38 g and shaped in the form of a ¼ cone, is used.

An example in which the foaming agent is added to the viscoelasticity material may be obtained by adding Sirasu (white sand) microballoon (SMB), glass microballoon (GMB) or the like having particle diameters of about 10 to 150 $\mu$m to a viscoelasticity material such as silicone rubber, urethane rubber or the like having a hardness range from 10 to 90 under the JIS Shore "A" durometer. A range from 10% to 50% is suitable as a composition thereof in a volume ratio. When the composition is less than 10%, a shock-wave buffering force is reduced. On the other hand, when the composition exceeds 50%, an influence exerted on viscoelasticity increases. Further, flowability becomes poor in manufacturing. Therefore, the composition other than the above suitable composition is not preferable. When the case for accommodating the electronic timer therein is of a cylindrical type in particular, it is preferable that, in the longitudinal direction of the case, the capacitor is disposed substantially in parallel with the electrode plates of the capacitor (e.g., electrode aluminum foils in the case of an aluminum electrolytic capacitor). This is because when the capacitor is disposed in a state in which the direction of the capacitor is perpendicular to the longitudinal direction of the case, the cylindrical case is susceptible to impacts applied from the upward and downward directions since no rigid walls are provided, thereby causing a possibility that the electrode plates will be close to each other due to the impacts so as to produce a dielectric breakdown or they will be brought into contact with each other so as to produce an internal short-circuit discharge.

(5) An explosive is configured in accordance with a method of inserting only the electric detonator into the explosive and providing the electronic timer outside the explosive.

When a detonator is charged with a slurry explosive in water and is put into use, the detonator placed in the explosive is subjected to a pressure corresponding to several times the pressure of an ambient underwater shock wave when the detonator is subjected to the impact. Thus, in such a case, the electronic timer may preferably not be inserted into the explosive.

(6) If the electronic timer performs counting a time period using the characteristic frequency of the quartz oscillator as the reference, then a high-accuracy detonation delay time of the electronic delay detonator can be achieved.

Figure 8A:
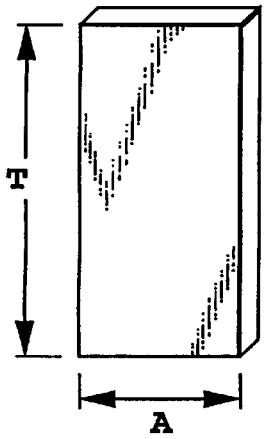
Figure 8B:
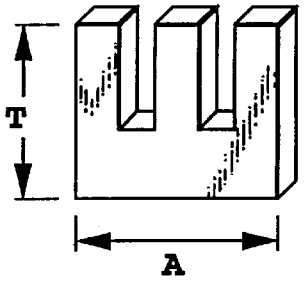
Figure 8C:
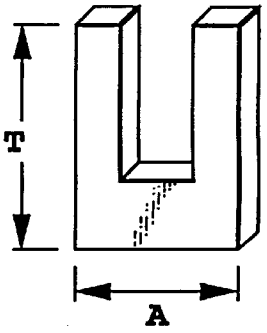

The quartz oscillator is roughly divided into three types according to the shape of a crystal rod as shown in FIGS. 8A, 8B and 8C; the first type is an AT-type one (see FIG. 8A) having a flat shape substantially equal in thickness or a convex lens-like shape which is thick in the neighborhood of the center and becomes thinner as approaching to the edge thereof; the second type is an E-type one (see FIG. 8B) equal in thickness and having an E-shaped plate-like configuration; and the third type is a tuning fork type (see FIG. 8C) equal in thickness and having a tuning fork type plate-like shape.

Regardless of the above three types of quartz oscillator, antiaccelerating performance is improved so that the operating range of the electronic timer can be enlarged by using a quartz oscillator having a length T of the crystal rod, which ranges from 2.0 mm to 3.5 mm, and a ratio T/A of the length T of the crystal rod to a width A, which ranges from 2.0 to 3.5, more preferably, the length T of the crystal rod, which ranges from 2.0 mm to 3.0 mm, and the ratio T/A of the length T of the crystal rod to the width A thereof, which ranges from 2.0 to 3.0. In this case, a thickness range from 100 $\mu$m to 200 $\mu$m is suitable as the thickness of the crystal rod. The length of the crystal, which is 2 mm and under is not preferable because the impedance increases in terms of the circuit and manufacturability becomes deteriorated and the cost increases.

(7) Moreover, by constructing the delay circuit of a first oscillator circuit having a quartz oscillator as a reference, a second oscillator circuit, a clock or count period producing circuit for producing a count period using the second oscillator circuit so that the count period coincides with a reference period generated by the first oscillator circuit; and a trigger signal generating circuit for outputting the trigger signal with the count period as the reference, a problem of low impact resisting properties of the quartz oscillator can be completely resolved and counting a time period can be performed with high accuracy.

Preferably, the trigger signal generating circuit comprises a reference pulse output circuit for generating a pulse signal with the count period as a reference, and a main counter circuit for outputting the trigger signal when it has counted the reference pulse by a preset number of times.

Further, the count period producing circuit comprises a circuit for generating a count period creation start signal and a count period creation end signal when the count period producing circuit has counted the pulse outputted from the first oscillator circuit by first and second preset numbers, and a periodic counting data circuit for starting the counting of the pulse outputted from the second oscillator circuit upon receipt of the count period creation start signal, terminating the counting of the output pulse of the second oscillator circuit upon receipt of the count period creation end signal, and then fixing the result of the counting as a count period.

More preferably, the count period producing circuit has means for producing, as the reference period, first through nth ($\geqq 2$) fixed time intervals which are predetermined and different from one another, in which the minimum fixed time interval is equal to the minimum ignition time interval, using the pulse produced from the first oscillator circuit as a reference. The trigger signal generating circuit comprises first to nth separating means for respectively separating predetermined delay time intervals in reverse order by a predetermined numbers of times in accordance with the first through nth fixed time intervals using a pulse train produced from the second oscillator circuit as a reference, and a circuit for generating the trigger signal when the predetermined delay time intervals have been separated by the predetermined number of times at the first fixed time interval by the first separating means.

The first through nth fixed time interval producing means comprise a first fixed time interval producing counter for counting the pulse train generated from the first oscillator circuit during the first fixed time interval and second through nth fixed time intervals producing counters for respectively counting the pulse train generated from the first oscillator circuit during the second through nth fixed time intervals.

Further, the first through nth separating means respectively comprise latch circuits for latching the first through nth fixed time intervals, first through nth separating counters, to which the first through nth fixed time intervals latched in the latch circuits are set and-which respectively serve so as to count the pulse train produced from the second oscillator circuit and output pulse signals every countups, and first through nth counters, which count pulses outputted from the first through nth separating counters each time the first through nth separating counters count up and which are activated in serial so as to release the reset of the (m−1) th counter in response to the countup of the m th($\leqq$n ) counter.

The aforementioned methods can be used singly or in combination according to the intended purpose.

Second Basic Mode of the Present Invention

Figure 2:
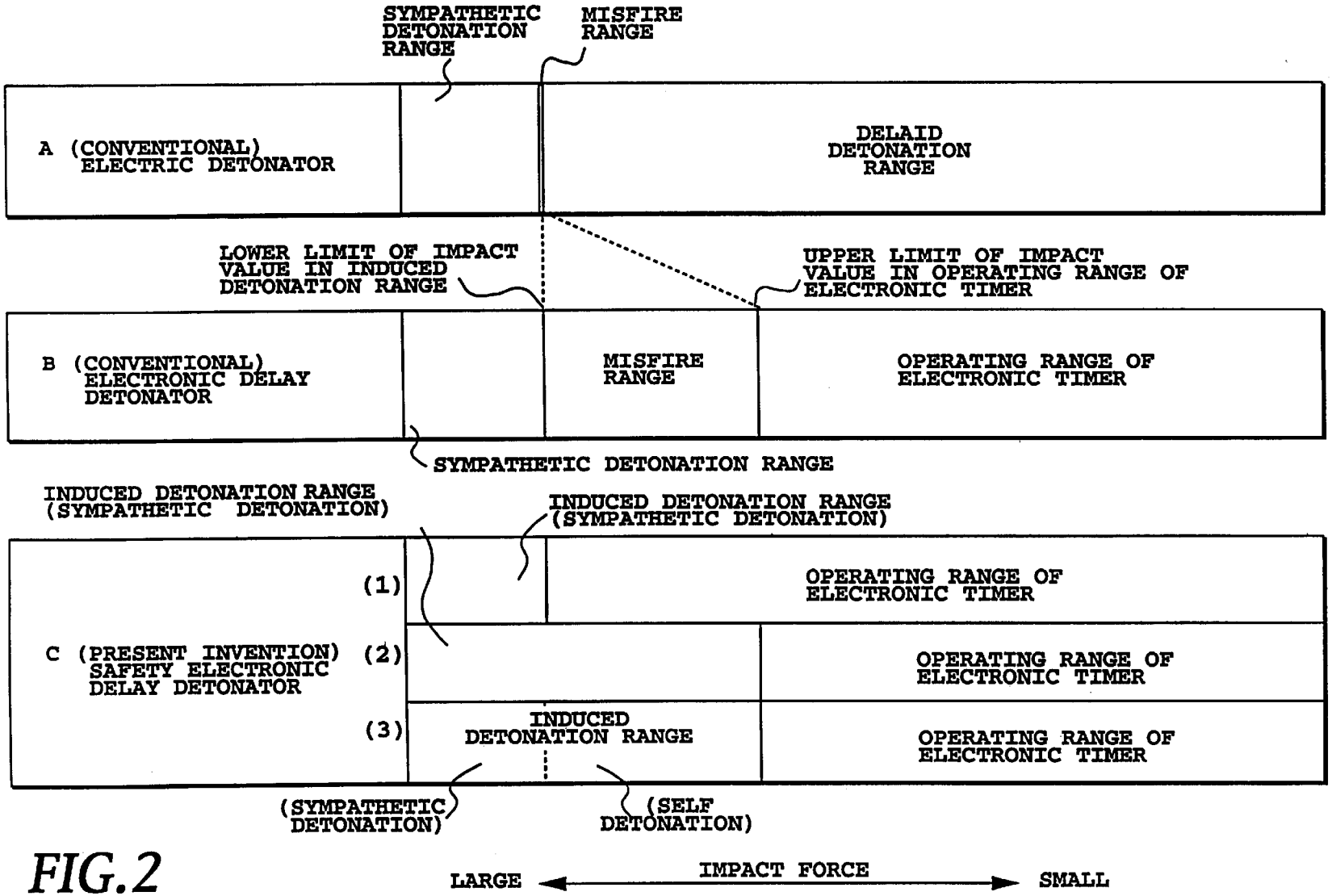
FIG. 2 is a conceptional view comparatively illustrating characteristics of an induced detonation range and an electronic-timer operating range in an electronic delay detonator and those of a conventional delay detonator.

In the second basic mode of the present invention, the lower limit of an impact value in a sympathetic detonation range of the electric detonator is enlarged to the neighborhood of the upper limit of an impact value in the operating range of the electronic timer or until the above range overlaps with the lower limit of the impact value, thereby eliminating a misfire range (refer to FIG. 2-C-(2)).

The sensitivity of induced detonation of the detonator varies according to a space length (see L in FIG. 5A) defined between an ignition charge layer and a primary explosive layer. When the space length is ranges from 4 mm to 14 mm in particular, the sympathetic detonation range can be greatly enlarged.

Third Basic Mode of the Present Invention

In the third basic mode of the present invention, an electronic timer has means for forcibly firing an electric detonator upon detecting its malfunction or even an indication of its malfunction for an unexpected reason in which a blasting shock is principal (see FIG. 2-C-(3)).

The electronic timer comprises a malfunction detecting circuit for detecting a malfunction of a circuit element, which occurs when the electronic timer is subjected to an explosive shock to thereby output a malfunction detected signal therefrom, a forced trigger circuit for outputting a forced trigger signal in response to the malfunction detected signal, and a switching circuit for supplying the ignition element with electrical energy stored in the energy charging circuit in response to the forced trigger signal.

(1) The malfunction detecting circuit comprises a failed quartz oscillator detecting circuit for detecting a failure in operation of a quartz oscillator.

(2) The malfunction detecting circuit may be composed of a circuit for detecting a malfunction of the energy charging circuit. Preferably, the malfunction detecting circuit is configured so as to detect a value of a voltage of the energy charging circuit after completion of the charging of the energy charging circuit and detect that the voltage value has reached down to the minimum firing voltage for firing an electric detonator. Alternatively, the malfunctioned energy charging circuit detecting circuit may be configured so as to detect, after completion of the charging of the energy charging circuit, that a discharge voltage vs. time gradient of the energy charging circuit is larger than a specific value.

Owing to these configurations, since the electronic delay detonator is self-detonated under forced ignition, for example, when the detonator accepts an impact value corresponding to a valve in a misfire range, the induced detonation range is placed in continuation with the operating range. This equivalently results in that the sympathetic detonation range is enlarged to the neighborhood of the operating range of the electronic timer or until the above range overlaps with the operating range of the impact value so that the misfire range is eliminated. Incidentally, the above means can be utilized singly or in combination.

The aforementioned three modes should be used singly or in combination according to the intended application.

The concepts of these modes will be shown in FIG. 2.

Preferred embodiments of the present invention will now be described in detail with reference to the accompanying drawings.

First Embodiment

Figure 3:
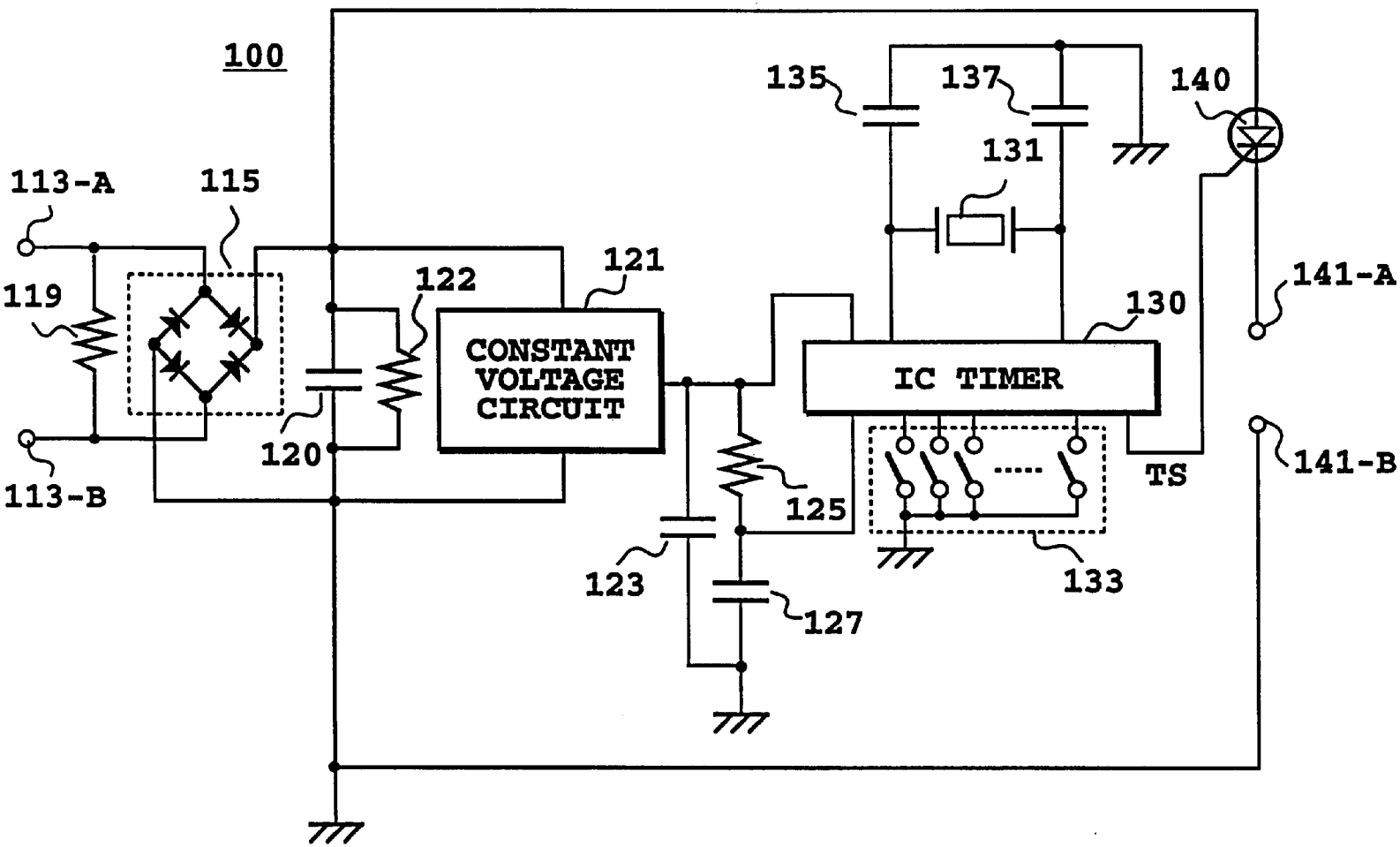
FIG. 3 is a circuit diagram showing an example of a configuration of an electronic timer employed in an electronic delay detonator according to the present invention.
Figure 4A:
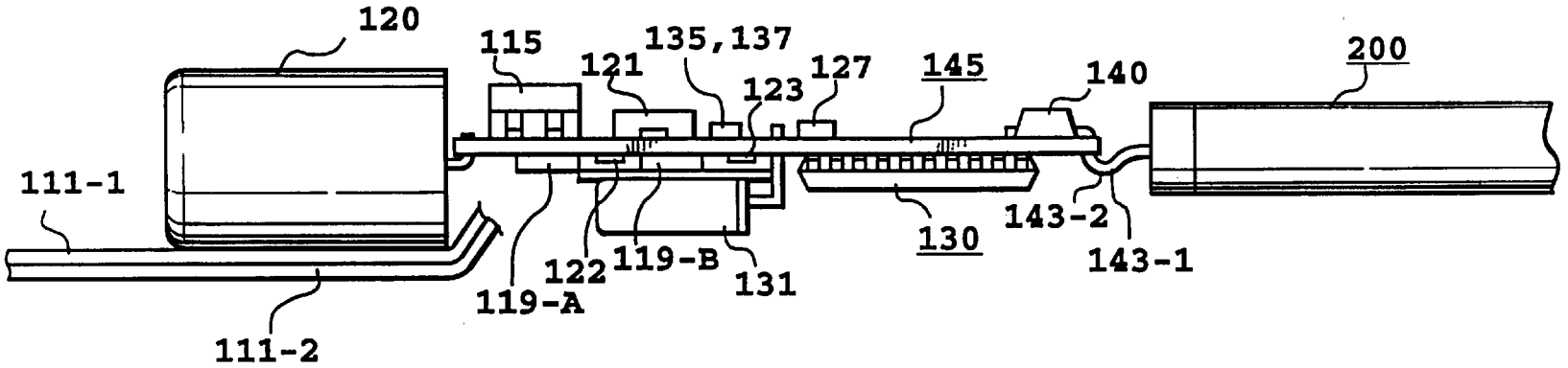
Figure 4B:
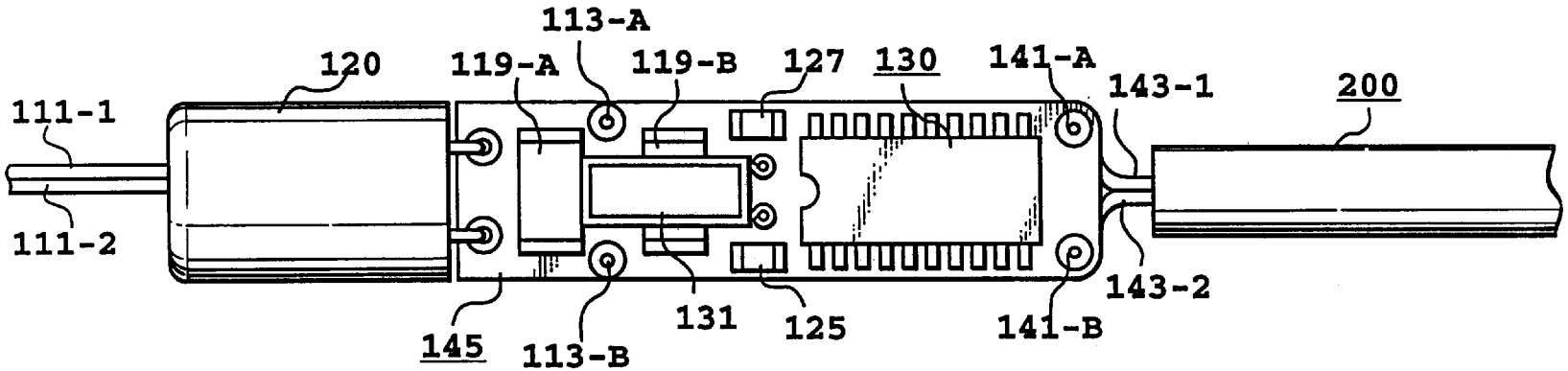

FIG. 3 is a block diagram showing a configuration of a hybrid integrated circuit (HIC) of an electronic delay detonator according to first embodiment of the present invention. FIGS. 4A and 4B respectively illustrate an HIC module of a type wherein the HIC shown in FIG. 3 has actually been mounted on a substrate. Incidentally, the present embodiment corresponds to the paragraphs (1), (2) and (6) shown in the aforementioned first basic mode, and the aforementioned second basic mode. The present embodiment will be described below with reference to the accompanying drawings.

As shown in FIG. 3, the HIC is configured such that electrical energy is supplied from an electric blasting machine (not shown) through a leading wire, a connecting wire (not shown) and a leg wire 111-1 (see FIGS. 4*a* and 4B) upon blasting. The leg wire 111-1 is connected to input terminals 113-A and 113-B of the HIC shown in FIG. 3 by soldering. A rectifier 115 for providing the match between the polarity of an input and that of an internal circuit, is connected between the input terminals 113-A and 113-B which receive the electrical energy supplied from the electric blasting machine.

An energy capacitor 120 is connected in parallel between the output terminals of the rectifier 115 so as to be able to charge input energy from either direction. A by-pass resistor 119 is connected in parallel with the capacitor 120 and in parallel between the input terminals of the rectifier 115. Further, input terminals of a constant voltage circuit 121 are connected in parallel with the capacitor 120. A resistor 122 for accelerating discharge is connected in parallel with the capacitor 120 and between the input terminals of the constant voltage circuit 121. The by-pass resistor 119 prevents stray current, which may often take place in blasting site, from charging the capacitor 120 to such a voltage in firing the detonator. The resistor 122 is used to quickly discharge the charged electrical energy in the capacitor 120 when the electronic delay detonator remains in a misfire state for some reasons after the electrical energy is supplied from the blasting machine.

To an output terminal of the constant voltage circuit 121 are connected a time constant circuit for producing a holding time required to reset an internal function of an IC timer 130, which is composed of a serial circuit of a resistor 125 and a capacitor 127, a filter capacitor 123 for stabilizing the output of the constant voltage circuit 121, and a power supply terminal of the IC timer 130. An output voltage of the time constant circuit is input into the IC timer 130, and then is compared with an output voltage of a reference voltage generating circuit (not shown) incorporated in the IC timer 130 by a comparator (not shown) comprising the IC timer 130. When these two voltage levels coincide with each other, a reset-release signal is output inside the IC timer 130.

Further, the IC timer 130 comprises an oscillator circuit (not shown) using a characteristic frequency of a quartz oscillator 131 as a reference, a frequency divider (not shown) for frequency-dividing an output pulse of the oscillator circuit into reference frequency pulses each having a period of 1 ms in response to the reset-release signal mentioned above, and a counting circuit (not shown) for counting the output pulses of the frequency divider by the number determined by a switching circuit 133 and outputting a trigger signal TS after completion of the counting. A gate capacitor 135 and a drain capacitor 137 of an oscillating inverter (not shown) are connected between the quartz oscillator 131 and the ground as shown in FIG. 3.

A serial circuit of an electronic switching device (e.g., a thyristor) 140 and an igniting resistor (not shown) for an electric detonator are connected across the capacitor 120 so that the electronic switching device may be closed in responses to the trigger signal TS so as to discharge the electrical energy stored in the capacitor 120 to the igniting resistor through leg wires 143-1 and 143-2 for an electric detonator (see FIGS. 4A and 4B) respectively soldered to output terminals 141-A and 141-B.

The aforementioned all-chip form parts or package form parts are mounted on a substrate (printed board) 145 by soldering. Further, the leg wires 111-1, 111-2, 143-1 and 143-2, the electrolytic capacitor 120 and the quartz oscillator 131 are allowed to extend through their corresponding through-holes defined in the board 145 and are soldered onto the board 145.

Further, the present embodiment is configured as a suitable specific example as follows: Namely, the capacitor 120 is composed of an electrolytic capacitor (1,000 $\mu$F), and the resistors 119 and 122 are respectively composed of chip type resistors of 15Ω and 200 kΩ. The rectifier 115 and the constant voltage circuit 121 are respectively constructed of packaged chip-like parts. The resistor 125 is composed of a chip type resistor and the capacitors 123 and 127 are respectively composed of multilayer ceramic capacitors. Further, the IC timer 130 is made up of a one-chip CMOS-IC and configured in a package form. The drain capacitor 137 and the gate capacitor 135 are respectively composed of multilayer ceramic capacitors. Furthermore, the electronic switching device 140 is comprised of a packaged chip-shaped SCR (Silicon Controlled Rectifier).

Figure 5A:
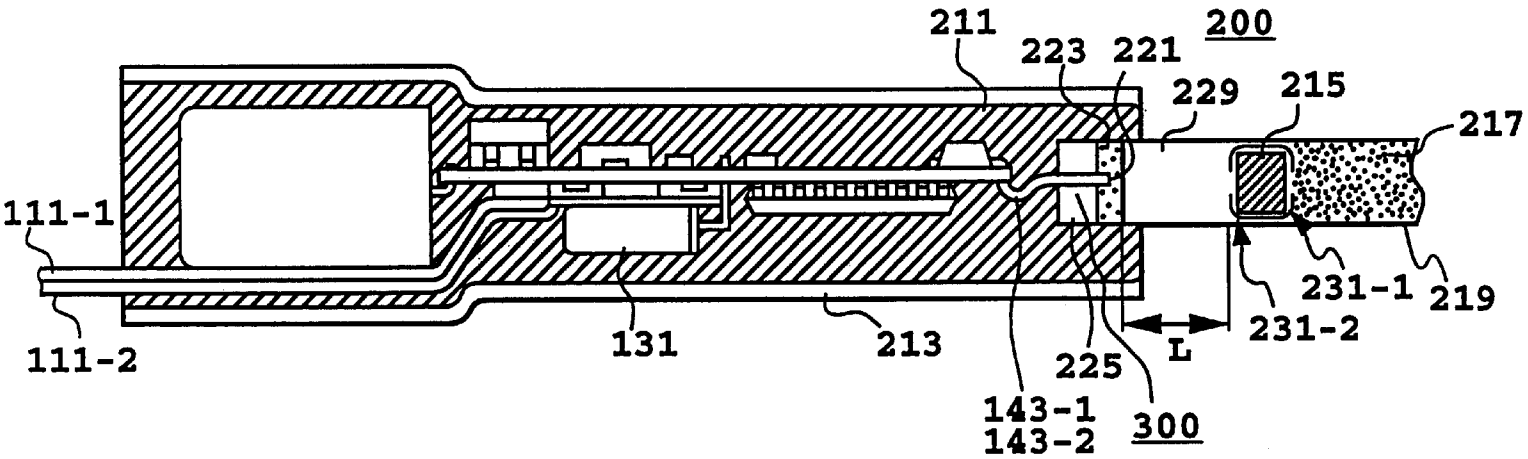
FIG. 5A is a sectional view showing one example of the structure of the electronic delay detonator shown in FIG. 3.
Figure 5B:
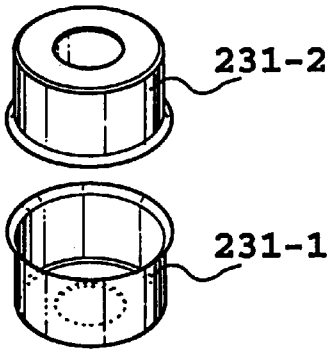
FIG. 5B is a perspective view illustrating the structure of an inner shell incorporated into the electronic delay detonator.

FIG. 5A illustrates the arrangement inside the electronic delay detonator according to the first embodiment. According to the present embodiment, the HIC module configured as described referring to FIGS. 3, 4A and 4B is inserted into a stainless steel-made metal housing 213 (whose outer diameter and thickness are respectively 15 mmø and 1.5 mm). In this condition, the resin is charged into the metal housing so that a resin layer 211 is formed in the housing. A two-part epoxy compounded resin (Trade Name: TB2023 (Chief Material)/TB2105F (Curing Agent) manufactured by Three Bond Company) which has a slow hardening property and flexibility, is used as the resin to be charged.

Further, an electric detonator 200 comprises a shell 219 which contains a base charge 217, a primary explosive 215, a space 229, an ignition element 300 composed of a seal plug 225, ignition charge 223 and an ignition resistance wire 221 connected through the seal plug 225 and the leg wires 143-1, 143-2. The electric detonator 200 is coupled to the HIC module through leg wires 143-1, 143-2 which are connected with the ignition resistance wire 221.

The arrangement of the respective members of the electric detonator 200 is as follows: The ignition charge 223 is provided around the ignition resistance wire 221. The primary explosive 215 is inserted between a first inner shell 231-1 and a second inner shell 231-2 adjacent to the space 229 extending from the ignition charge layer 223 as shown in FIG. 5A. The base charge 217 is charged in the direction of the leading end of the electric detonator 200 so as to contact with the primary explosive 215.

A blasting shock test was effected in water on the electronic delay detonator constructed as described above while its structure and the condition of blasting shock test were being changed in various ways. The blasting shock that the electronic delay detonator undergoes in water, can be assumed to correspond to a case where the electronic delay detonator is subjected to compression in all the directions through a spring water expected to be produced at an actual blasting site. A slurry explosive (100 g: inch size explosive in diameter) was used as the source of generation of the blasting shock and was placed at a depth of 2 m under water with samples placed at a predetermined distance away from the slurry explosive. Further, the distance was changed in various ways and the type of sample was changed variously.

The result of the blasting shock test, which was carried out by changing the length (corresponding to L shown in FIG. 5A) of the space 229 between the ignition charge layer 223 and the primary explosive layer 215, will be presented in Table 1 shown below. According to the result of Table 1, it is understood that if the configuration of the electric detonator 200, i.e., the space distance L between the ignition charge layer 223 and the primary explosive layer 215 is set so as to fall within a range from 4 mm to 14 mm, then the sympathetic detonation range is enlarged. It is also understood that if the space length L falls within a range of 8 mm to 14 mm as the much preferable condition, then the electric detonator 200 is sympathetically detonated even when the quartz oscillator employed in the present embodiment is subjected to damage by the blasting shock, whereby a misfire is avoidable.

Further, the result of the blasting shock test, which was carried out by changing the size of a crystal rod under a hard-to-produce sympathetic detonation condition in which the space length is fixed to 0 mm, under the same condition of the blasting shock test as above, will be presented in Table 2 shown below. According to the result of Table 2, when a quartz oscillator is used in which the length T of the crystal of the quarts oscillator is less than or equal to 3.5 mm and the ratio T/A between the length T and width A of the crystal rod is less than or equal to 3.5, it is understood that the operating range of the electronic timer 100 is greatly enlarged as compared with other samples. Particularly when a quartz oscillator is used in which the length T of a crystal rods is 2.48 mm and the ratio T/A between the length T and width A of the crystal is 2.48, the most satisfactory result is obtained.

Furthermore, the result of the blasting shock test, which was carried out by varying combinations of the space length and the crystal size under the same condition of a shock test as described above, will be presented in Table 3 shown below. According to the result of Table 3, it is understood that the selection of the shape of the crystal permits an increase in operation limit of the electronic timer 100, and various impact resisting levels can be set not so as to cause any misfire by changing the space length.

Still further, the result of the blasting shock test, which was carried out by changing, in various forms under the same condition of the above blasting shock test, the material to be encapsulated when the HIC module is inserted into the stainless steel-made metal housing 213 (whose outer diameter and thickness are respectively 15 mmø and 1.5 mm) and comparing the changed materials, will be presented in Table 4 shown below. According to the result of Table 4, it is understood that the impact resisting properties of the quartz oscillator are improved by using a gel-like silicone resin as an encapsulant.

TABLE 1

| Space length between ignition charge layer and primary explosive layer (mm) | Quartz oscillator: Type | Crystal size (mm): Overall length T | Width A | Thickness | T/A | Operating conditions of electronic timer according to blasting shock distance (number of normal detonation/number of experiments): 15 cm | 25 cm | 35 cm | 45 cm | 75 cm |
|---|---|---|---|---|---|---|---|---|---|---|
| 0 | AT | 7.0 | 1.7 | 0.1–0.4 | 4.1 | 0/6 *6/6 SD | 0/6 *4/6 SD *2/6 CD | 0/6 *6/6 CD | 1/6 *5/6 CD | 6/6 |

TABLE 1-continued

| Space length between ignition charge layer and primary explosive layer (mm) | Quartz oscillator Type | Crystal size (mm) Over-all length T | Width A | Thick ness | T/A | Operating conditions of electronic timer according to blasting shock distance (number of normal detonation/number of experiments) 15 cm | 25 cm | 35 cm | 45 cm | 75 cm |
|---|---|---|---|---|---|---|---|---|---|---|
| 4 | AT | 7.0 | 17 | 0.1–0.4 | 4.1 | 0/6 *6/6 SD | 0/6 *6/6 SD | 0/6 *1/6 SD *5/6 CD | 2/6 *4/6 CD | 6/6 |
| 8 | AT | 7.0 | 1.7 | 0.1–0.4 | 4.1 | 0/6 *6/6 SD | 0/6 *6/6 SD | 0/6 *6/6 SD | 1/6 *5/6 SD | 6/6 |
| 14 | AT | 7.0 | 1.7 | 0.1–0.4. | 4.1 | 0/6 *6/6 SD | 0/6 *6/6 SD | 0/6 *6/6 SD | 0/6 *6/6 SD | 6/6 |

Note) *: Failure mode
SD: Sympathetic detonation
CD: Crystal destruction

TABLE 2

| Space length between ignition charge layer and primary explosive layer (mm) | Quartz oscillator Type | Crystal size (mm) Over-all length T | Width A | Thick ness | T/A | Operating conditions of electronic timer according to blasting shock distance (number of normal detonation/number of experiments) 15 cm | 25 cm | 35 cm | 45 cm | 75 cm |
|---|---|---|---|---|---|---|---|---|---|---|
| 0 | AT | 7.0 | 1.7 | 0.1–0.4 | 4.1 | 0/6 *6/6 SD | 0/6 *4/6 SD *2/6 CD | 0/6 *6/6 CD | 1/6 *5/6 CD | 6/6 |
| 0 | Tuning fork | 4.5 | 1.0 | 0.2 | 4.5 | 0/6 *6/6 SD | 0/6 *4/6 SD *2/6 CD | 0/6 *6/6 CD | 1/6 *5/6 CD | 6/6 |
| 0 | Tuning fork | 3.5 | 0.9 | 0.3 | 3.9 | 0/6 *6/6 SD | 0/6 *4/6 SD *2/6 CD | 1/6 *5/6 CD | 2/6 *4/6 CD | 6/6 |
| 0 | Tuning fork | 3.5 *6/6 SD | 1.0 *4/6 SD | 0.2 | 3.5 | 0/6 | 0/6 *2/6 CD | 6/6 | 6/6 | 6/6 |
| 0 | Tuning fork | 2.48 | 1.0 | 0.1 | 2.48 | 0/6 *6/6 SD | 0/6 *4/6 SD | 6/6 | 6/6 | 6/6 |

Note) *: Failure mode
SD: Sympathetic detonation
CD: Crystal destruction

TABLE 3

| Space length between ignition charge layer and primary explosive layer (mm) | Quartz oscillator Type | Crystal size (mm) Overall length T | Width A | Thickness | T/A | Operating conditions of electronic timer according to blasting shock distance (number of normal detonation/number of experiments) 15 cm | 25 cm | 35 cm | 45 cm | 75 cm |
|---|---|---|---|---|---|---|---|---|---|---|
| 14 | AT | 7.0 | 1.7 | 0.1–0.4 | 4.1 | 0/6 *6/6 SD | 0/6 *6/6 SD | 0/6 *6/6 SD | 0/6 *6/6 SD | 6/6 |
| 8 | Tuning fork | 4.5 | 1.0 | 0.2 | 4.5 | 0/6 *6/6 SD | 0/6 *6/6 SD | 0/6 *6/6 SD | 1/6 *5/6 SD | 6/6 |
| 8 | Tuning fork | 3.5 | 0.9 | 0.3 | 3.9 | 0/6 *6/6 SD | 0/6 *6/6 SD | 0/6 *6/6 SD | 2/6 *4/6 SD | 6/6 |
| 4 | Tuning fork | 3.5 | 1.0 | 0.2 | 3.5 | 0/6 *6/6 SD | 0/6 *6/6 SD | 5/6 *1/6 SD | 6/6 | 6/6 |
| 4 | Tuning fork | 2.48 | 1.0 | 0.1 | 2.48 | 0/6 *6/6 SD | 0/6 *6/6 SD | 5/6 *1/6 SD | 6/6 | 6/6 |
| 0 | Tuning fork | 2.48 | 1.0 | 0.1 | 2.48 | 0/6 *6/6 SD | 2/6 *4/6 SD | 6/6 | 6/6 | 6/6 |

Note) *: Failure mode
SD: Sympathetic detonation

TABLE 4

| Encapsulant | Space length between ignition charge layer and primary explosive layer (mm) | Quartz oscillator Type | Crystal size (mm) Overall length T | Width A | Thickness | T/A | Operating conditions of electronic timer according to blasting shock distance (number of normal detonation/number of experiments) 35 cm | 40 cm | 45 cm | 50 cm | 75 cm |
|---|---|---|---|---|---|---|---|---|---|---|---|
| Epoxy resin | 4 | AT | 7.0 | 1.7 | 0.1–0.4 | 4.1 | 0/6 *1/6 SD | 0/6 | 0/6 | 0/6 | 6/6 |
| | | | | | | | *5/6 CD | *6/6 CD | *4/6 CD | *2/6 CD | |
| Silicon resin | 4 | AT | 7.0 | 1.7 | 0.1–0.4 | 4.1 | 0/6 *1/6 SD | 3/6 | 5/6 | 6/6 | 6/6 |
| | | | | | | | *5/6 CD | *3/6 CD | *1/6 CD | | |
| Expanded urethane resin | 4 | AT | 7.0 | 1.7 | 0.1–0.4 | 4.1 | 0/6 *1/6 SD | 2/6 | 4/6 | 6/6 | 6/6 |
| | | | | | | | *5/6 CD | *4/6 CD | *2/6 CD | | |

TABLE 4-continued

| Encapsulant | Space length between ignition charge layer and primary explosive layer (mm) | Quartz oscillator: Type | Crystal size (mm): Overall length T | Crystal size (mm): Width A | Crystal size (mm): Thickness | T/A | Operating conditions of electronic timer according to blasting shock distance (number of normal detonation/number of experiments): 35 cm | 40 cm | 45 cm | 50 cm | 75 cm |
|---|---|---|---|---|---|---|---|---|---|---|---|
| Gel-like silicon resin | 4 | AT | 7.0 | 1.7 | 0.1–0.4 | 4.1 | 2/6<br>*1/6 SD<br>*4/6 CD | 5/6<br>*1/6 CD | 6/6 | 6/6 | 6/6 |

Note) *: Failure mode
SD: Sympathetic detonation
CD: Crystal destruction

Second Embodiment

Figure 6A:
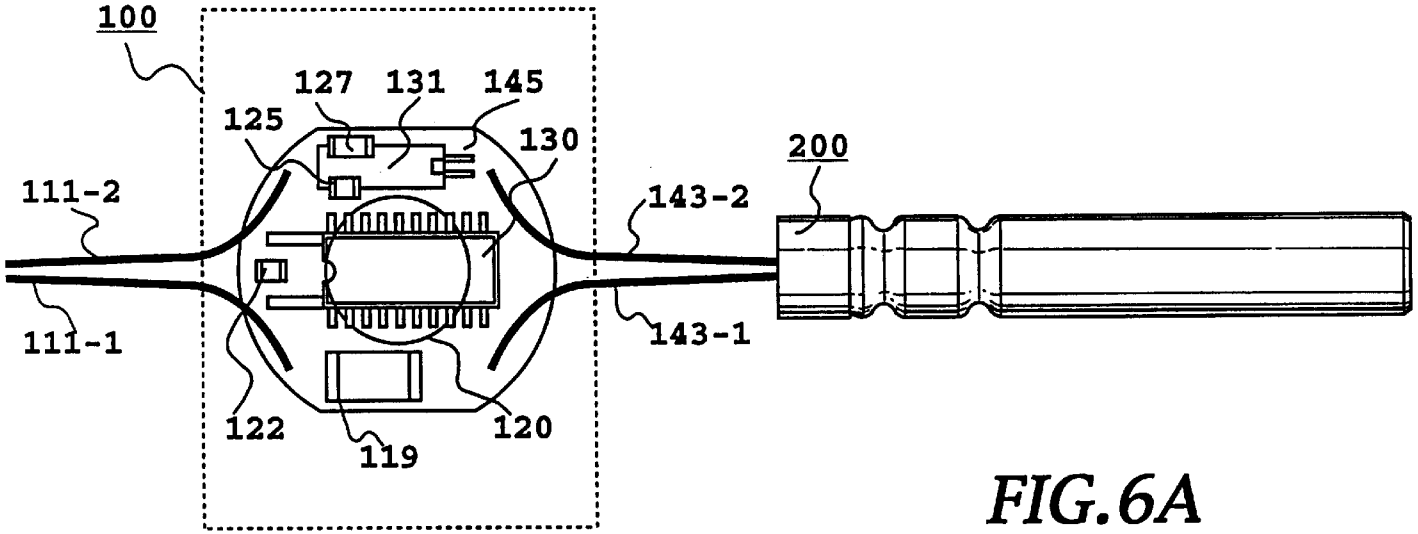
Figure 6B:
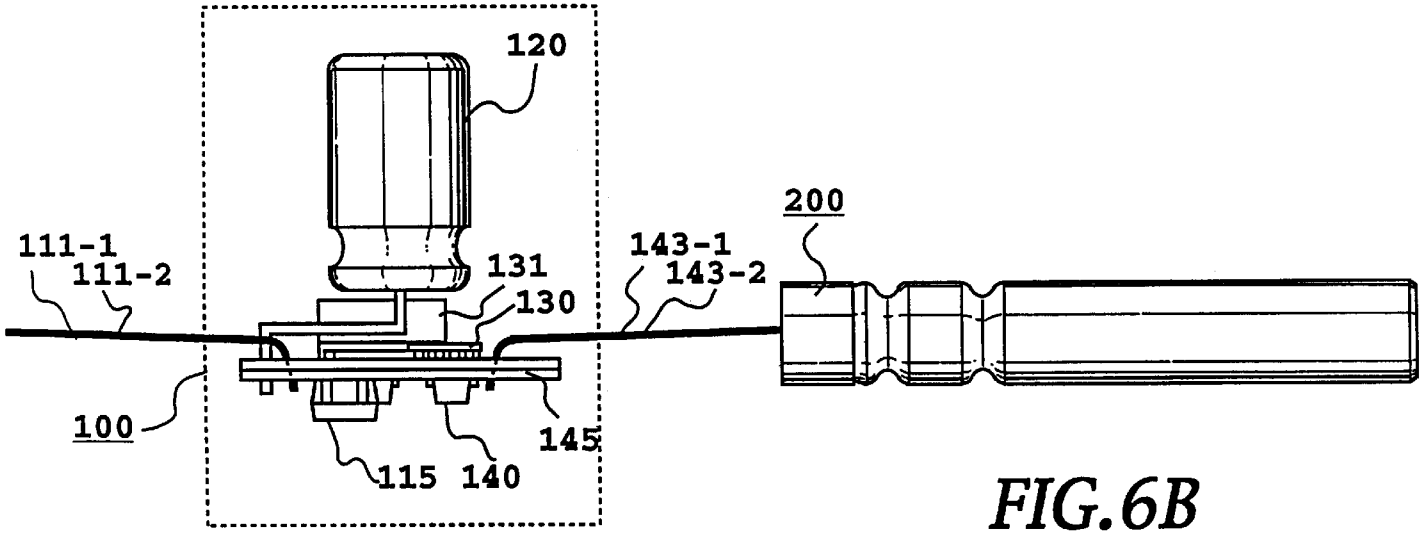
Figure 7:
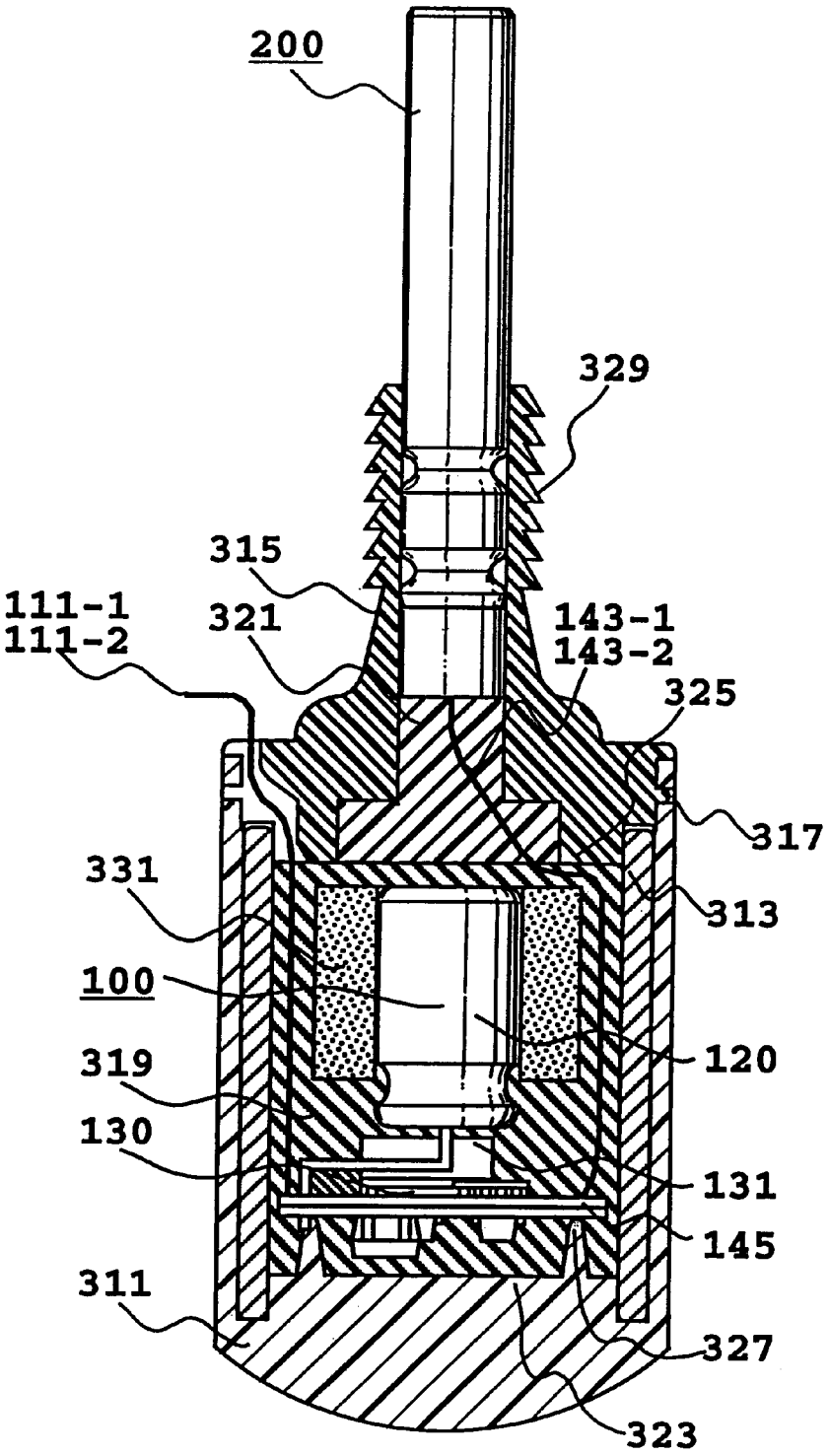
FIG. 7 is a sectional view illustrating another example of the structure of an impact-resisting electronic delay detonator according to the present invention.

FIGS. 6A and 6B respectively show an HIC module employed in the present embodiment, in which the hybrid circuit employed in the first embodiment has actually been mounted on a board. Incidentally, the state of electrical connections in FIG. 6 conforms to that shown in FIG. 4 illustrative of the first embodiment and its detailed description will therefore be omitted. FIG. 7 shows the structure of an electronic delay detonator having the HIC module shown in FIGS. 6A and 6B according to the second embodiment of the present invention. Incidentally, the present embodiment shows one embodiment corresponding to the paragraphs (1) through (5) of the aforementioned first basic mode. The present embodiment will be described below with reference to FIG. 7.

An electronic timer 100 is accommodated within a case 311 including a metal cylinder 313. The case 311 is coupled, via an engagement portion 317, with a cap 315 into which a part of an electric detonator 200 is inserted and fixed. Since the metal cylinder 313 is considered to cause accidental explosion due to collision with the electric detonator 200 during delivery when the metal cylinder 313 is exposed to the outside, it is preferable to cover the periphery of the metal cylinder 313 with plastic case or the like 311 in terms of safety handling as described in the present embodiment. A viscoelasticity material 319 is charged into a gap between the electronic timer 100 and the metal cylinder 313.

Described more specifically, the electronic timer 100 is composed of electronic devices including an energy capacitor 120, a quartz oscillator 131, an IC timer 130, etc. These electronic parts are all mounted on the surface of a board 145. The board 145 is made of glass epoxy. Further, the board 145 is a connected with leg wires 111-1 and 111-2 connected to a blasting machine (not shown) through the cap 315 on the input side, and is connected with leg wires 143-1, 143-2 of the electric detonator 200 connected through a stopper 321 for stopping the detonator in the output side.

Discrete parts such as the leg wires 111-1, 111-2, 143-1 and 143-2, the energy capacitor 120 and the quartz oscillator 131 penetrate their corresponding through holes defined in the board 145 and are soldered to the board 145. Parts of an inner surface and both surfaces of the board 145, which exist around the through holes, are stuck on the board 145 with conductive foil. Further, solder passes through a foil surface on the opposite side by soldering from one side of the board 145, so that the discrete parts are electrically and firmly connected to the board 145. Further, parts of the case 311 and the cap 315 constitute inner cap portions 323 and 325 at both ends of the metal cylinder 313. The inner cap portions 323 and 325 constructed as described above reinforce the metal cylinder 313 so that the metal cylinder 313 is prevented from crushing due to a blasting shock. The length required to engage the inner cap portions 323 and 325 with the metal cylinder 313 needs to have 3 mm at the minimum.

Further, a projection 327 is provided on the inner wall of the case 311. The projection 327 holds the electronic timer 100 in the normal position and normally keeps the gap between the metal cylinder 313 and the electronic timer 100. The gap is also provided so as to be fully charged with the viscoelasticity material 319. Owing to the provision of the board 145 at a right angle to the metal cylinder 313, the board 145 reinforces the metal cylinder 313 against the deformation of the metal cylinder 313 by the impact.

When the metal cylinder 313 is reduced in diameter, the board 145 may become slender so as to become parallel to the axis direction of the metal cylinder 313.

Further, the material used to form each of the case 311, the cap 315 and the detonator stopper 321 may be plastic, but may preferably be one having an elastic modulus of 100 $kg/mm^2$ or above. The material corresponding to this may be polyethylene, polyester, polypropylene, an ABS (acrylonitrile-butadiene-styrene) resin or the like, more preferably, nylon 66, polyacetal or the like having an elastic modulus of 200 $kg/mm^2$ or above.

An antidislocation stopper 329 may preferably be provided on the outer periphery of the cap 315 at a position where the cap 315 engages the detonator 200. Owing to the provision of the antidislocation stopper 329, the electronic delay detonator of the invention is hard to be released from an explosive (primer cartridge) inserted in the electronic delay detonator, thereby making it possible to improve blasting workability.

It is preferable that the input leg wires 111-1 and 111-2 and output leg wires 143-1 and 143-2, which extend to the electronic timer, are taken out from the same direction as the metal cylinder 313 in terms of manufacture of the electronic delay detonator of the present invention. This is because owing to such a construction, the cap 315 can be fit to the case 311 in one-touch operation through the engagement portion 317 by forcing the cap 315 provided with the electronic timer 100 into the case 311 including the metal cylinder 313 charged with a suitable amount of filler 319. On the other hand, when a resin 319 is injected into the case 311 after the cap 315 has been fit in the case 311, an injection port is necessary and air is easy to be taken into the resin 319. Therefore, such injection is not preferable.

A blasting shock test was carried out in water and sand while the type of filler 319 of the electronic delay detonator constructed as described above and the condition of shock test were being varied. A blasting shock that the electronic delay detonator undergoes in water, is assumed to correspond to a state in which the electronic delay detonator is subjected to compression in all the directions through a spring water expected to be produced at an actual blasting site as described above. A blasting shock that the electronic delay detonator undergoes in sand, is assumed to correspond to two states: one in which the electronic delay detonator is expelled by vibrations in an elastic range of rock so that displacement acceleration is produced; and the other in which explosive gas enters through a crack of rock so that compression applied from one direction or displacement acceleration is produced.

The material used for the metal cylinder 313 was STKM steel (Carbon Steel Pipe for mechanical structure; JIS G 3445 12typeC/SymbolSTKM12C) having anouter diameter of 27 mmø, a thickness of 1.7 mm and a length of 34 mm. A glass epoxy substrate having an outer diameter of 23 mmø and a thickness of 0.8 mm and an AT-type quartz oscillator of 4 MHz were used for the electronic timer. An aluminum electrolytic capacitor of 16 wV and 1000 $\mu$F (10 mmø–16 mmL) was used as the capacitor. Further, the thickness of a capacitor protective material 331 was set so as to range from 2 mm to 4 mm and the metal cylinder 313 was charged with a viscoelasticity material of 7 cc to 10 cc.

The blasting shock test was carried out under the following conditions. Namely, a slurry explosive (100 g: inch size explosive in diameter) was used as the source of generation of the blasting shock and was placed at a depth of 2 m under water and at a depth of 80 cm in sand with samples placed at a predetermined distance away from the slurry explosive. Further, the distance was changed in various forms and the type of sample was changed variously. After application of the blasting shock, the tested sample was recovered and the presence or absence of damage was examined.

The result of the blasting shock test will be presented in Table 5 shown below. According to the result of Table 5, it is understood that the effects of the present invention are greatly produced: the damage of the electronic timer 100 is lessened by covering the electronic timer 100 with the viscoelasticity material 319; and the abnormal discharge of the charge stored in the capacitor 120 is less produced by covering the periphery of the capacitor 120 with a low-density material 331.

TABLE 5

| Name of filler | Hardness | Protection for periphery of capacitor | Shock distance (cm) In sand 10 | In sand 15 | In sand 20 | In water 40 | In water 50 | In water 60 | In water 75 | In water 90 | In water 105 |
|---|---|---|---|---|---|---|---|---|---|---|---|
| Epoxy | Rockwell R130 | No | 0/5 (13 V) | 4/5 (7 V) | 5/5 (1 V) | 0/5 (13 V) | 1/5 (7 V) | *2/5 (3 V) | 3/5 (1 V) | 5/5 | |
| | | Yes (Foamed PE) | 0/5 (12 V) | *4/5 (7 V) | 5/5 | 0/5 (3 V) | | *1/5 (1 V) | | | |
| PS | Rockwell R110 | No | 0/5 (13 V) | *4/5 (6 V) | 5/5 | 0/5 (10 V) | *2/5 (8 V) | *2/5 (3 V) | *4/5 | 5/5 | |
| Silicon rubber | Shore A 100 | No | 1/5 (8 V) | 5/5 (0 V) | 5/5 | *4/5 (8 V) | | *4/5 (3 V) | 5/5 | | |
| Silicon rubber | Shore A 90 | No | *2/5 (6 V) | 5/5 (0 V) | | *4/5 (7 V) | *4/5 (5 V) | | | | |
| | | Yes (Silicon gel) | *1/5 (4 V) | 5/5 (0 V) | | 5/5 (1 V) | 5/5 (1 V) | | | | |
| | | Yes (Added with GMB 15 vol %) | *2/5 (5 V) | 5/5 (0 V) | | 5/5 (2 V) | 5/5 (1 V) | | | | |
| Silicon rubber | Shore A 10 | No | *1/5 (5 V) | 5/5 (1 V) | | 5/5 (6 V) | 5/5 (3 V) | | | | |
| Silicon gel | Penetration 100 | No | 1/5 (4 V) | 5/5 (0 V) | | 5/5 (1 V) | 5/5 (0 V) | | | | |
| Silicon gel | Penetration 20 | No | (0/5) (4 V) | 5/5 | | 5/5 (1 V) | 5/5 (1 V) | | | | |

Note 1: Fraction indicates ratio of the number of normal circuit to the number of experiments. Number with symbol * means that only quartz oscillator produces damage and others are indicated as normal.
Note 2: Value in '() indicates drop voltage developed across capacitor at the time of application of shock.

Third Embodiment

Figure 9:
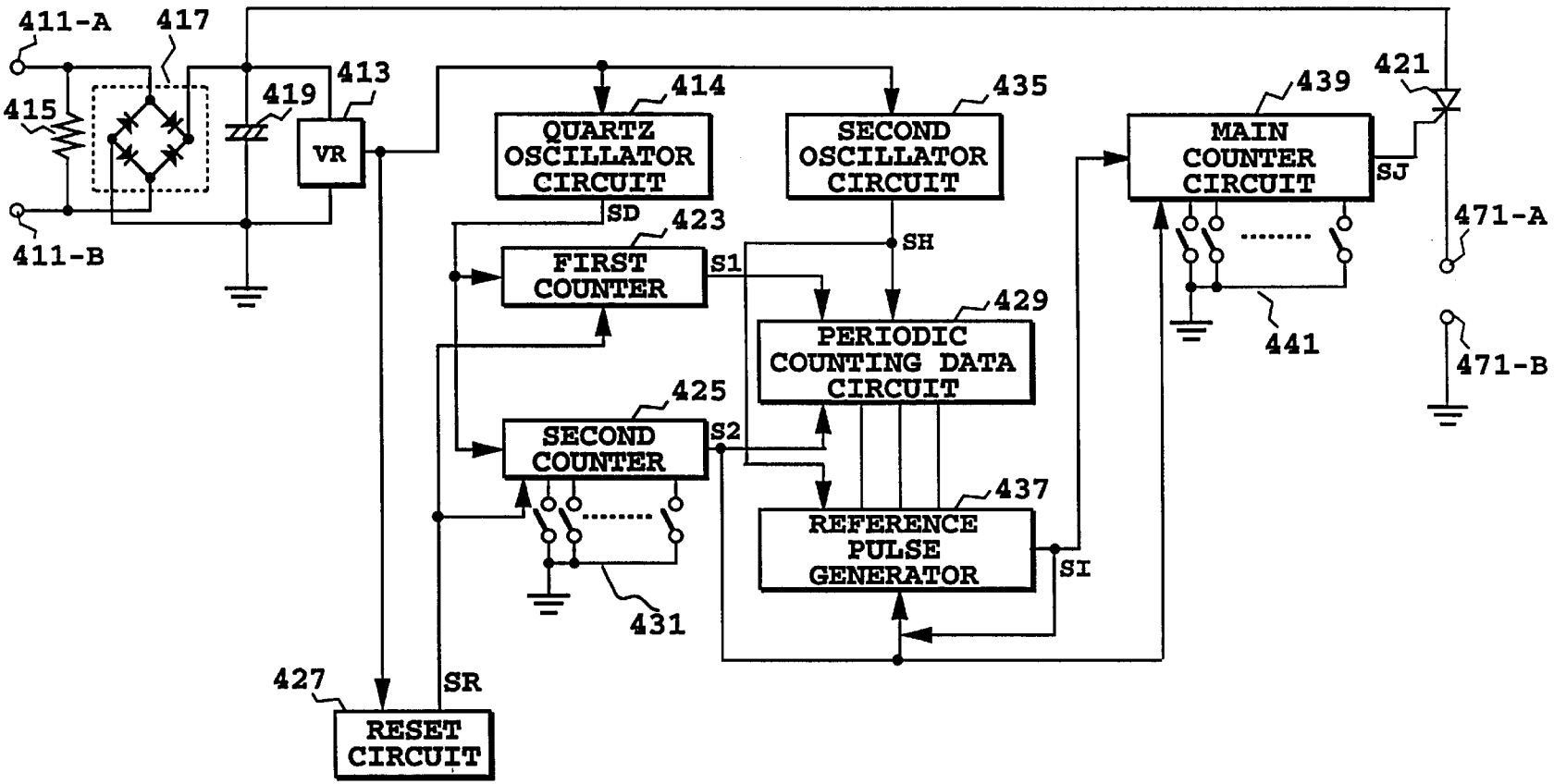
FIG. 9 is a circuit diagram showing a configuration of the IC timer of FIG. 3, which is employed in the embodiment of the present invention.
Figure 10:
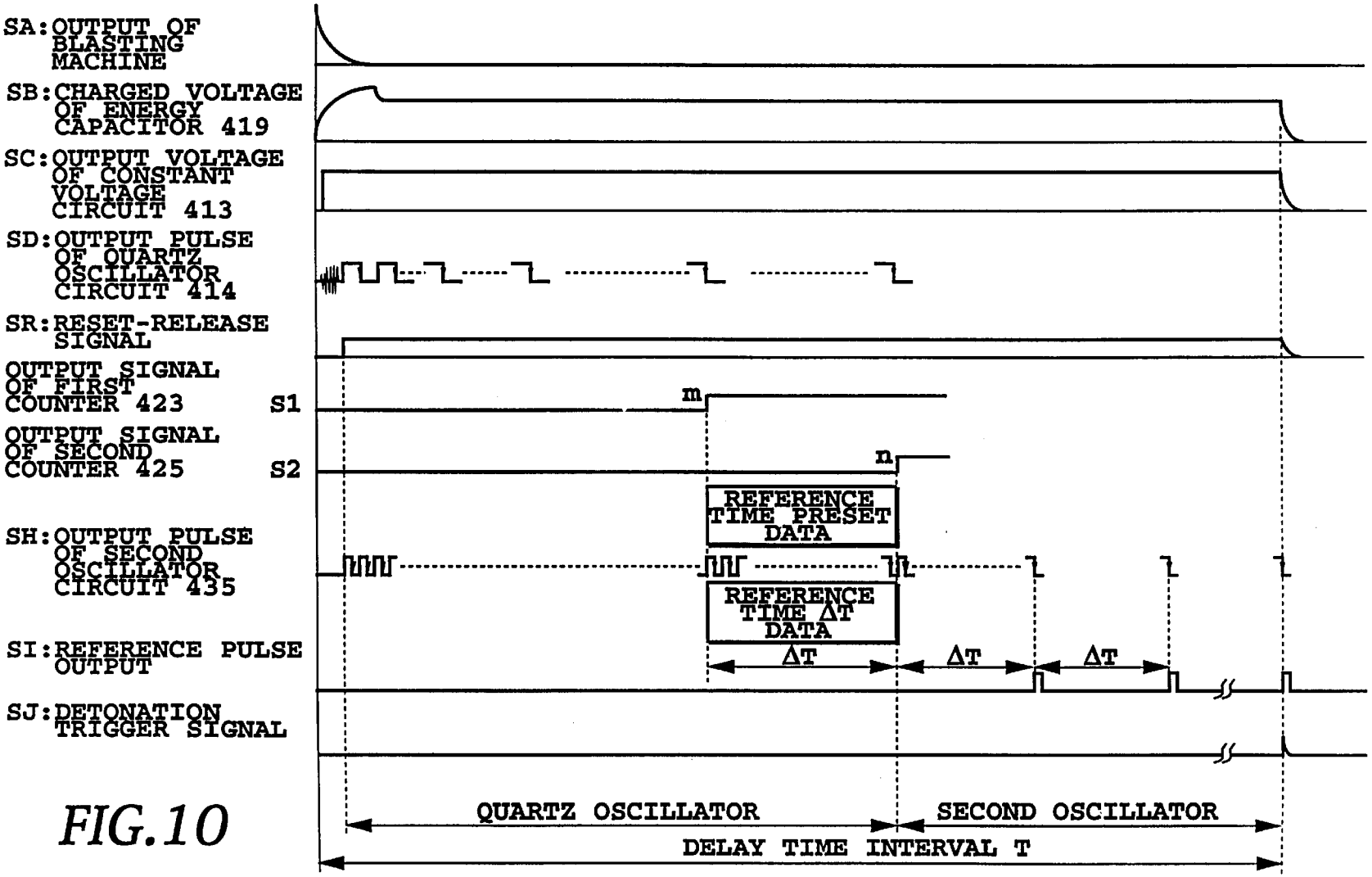
FIG. 10 is a timing chart for describing examples of timing at respective parts shown in FIG. 9.

A third embodiment of the present invention will now be described with reference to FIG. 9. Incidentally, the present embodiment corresponds to the paragraph (7) of the aforementioned first basic mode. FIG. 9 shows one example of an internal configuration of an IC timer 130 employed in the present invention. The IC timer 130 is configured under the same arrangement as that shown in FIG. 3 and is driven based on an output voltage of a constant voltage circuit 413. FIG. 10 is a timing chart for describing the operation of the IC timer 130 shown in FIG. 9.

In FIG. 9, reference numerals 411-A and 411-B respectively indicate input terminals, which are used to receive electrical energy supplied from an blasting machine (not shown). Reference numeral 415 indicates a by-pass resistor,. which is connected between the input terminals 411-A and 411-B and used to bypass a stray current. Reference numeral 417 indicates a diode bridge circuit, which serves so as to apply a predetermined polar voltage to an energy capacitor 419 regardless of the polarity of a DC voltage applied between the input terminals 411-A and 411-B and to prevent a current from flowing back to the input terminals 411-A and 411-B from energy capacitor 419. Reference numeral 413 indicates the constant voltage circuit, which uses the energy capacitor 419 as a power supply and outputs predetermined power.

Reference numeral 414 indicates a quartz oscillator circuit whose oscillating frequency is 3 MHz, for example. The quartz oscillator circuit 414 outputs an oscillating pulse SD to each of first and second counters 423 and 425. The first counter 423 is released from the reset state by a reset circuit 427, and thereby counts the oscillating pulse SD by a predetermined number (m), followed by outputting of a signal Si to a periodic counting data circuit 429.

The second counter 425 is released from the reset state by the reset circuit 427, and thereby counts the oscillating pulse SD by a number (n) set by a count data preset switch 431, followed by outputting of a signal S2 to the periodic counting data circuit 429. The number (n) set to the second counter 425 is larger than the number (m) counted by the first counter 423 (n>m).

A second oscillator circuit 435 may be one which is larger in impact strength and is resistible to a blasting shock of some adjacent explosives. As such an oscillator circuit, there may preferably be an oscillator circuit such as a CR oscillator circuit, a ring oscillator, an LC oscillator circuit or the like, or an oscillator circuit using a negative resistance of a Programmable unijunction transistor (PUT) or the like. The second oscillator circuit 435 outputs an oscillating pulse SH to each of the periodic counting data circuit 429 and a reference pulse generator 437.

The periodic counting data circuit 429 is released from the reset state in response to the signal S1 so as to count the oscillating pulse SH of the second oscillator circuit 435. Thereafter, the periodic counting data circuit 429 stops counting in response to the signal S2 and holds counted data (ΔT). The reference pulse generator 437 is released from the reset state in response to the signal S2 so as to count the output pulse SH of the second oscillator circuit 435 by the number corresponding to the counted data (ΔT) of the periodic counting data circuit 429, and outputs a reference clock signal SI to a main counting circuit 439, and also is reset in response to the signal SI.

The counted data (ΔT) is equivalent to a time determined based on the difference between the predetermined number (m) counted by the first counter 423 and the number (n) set by the count data preset switch 431, which has been counted by the second counter 425:

$$\Delta T=(n-m)t \tag{1}$$

(where t: period of quartz oscillator circuit 414)

The main counter circuit 439 is released from the reset state in response to the signal S2 so as to count the output signal SI of the reference pulse generator 437 by a number (N) set by a count data preset switch 441, and outputs a trigger signal SJ to an electronic switching device 421. The electronic switching device 421 is closed in response to the trigger signal SJ to form a switching circuit, so that the electrical energy stored in the capacitor 419 is discharged.

The operation of the circuit shown in FIG. 9 will now be described in detail with reference to the timing chart shown in FIG. 10. When an output SA produced from the blasting machine (not shown) is input into the input terminals 411-A and 411-B, the energy capacitor 419 is charged as indicated by a waveform SB in FIG. 10. The circuit shown in FIG. 9 is operated by the charged power. Thus, after completion of the charging of the energy capacitor 419, the quartz oscillator circuit 414 starts oscillating after the constant voltage circuit 413 has output a voltage (see SD in FIG. 10).

Further, the reset circuit 427 outputs a reset-release signal SR after a lapse of a predetermined time since the voltage has been outputted from the constant voltage circuit 413. A predetermined time required to output the reset-release signal SR corresponds to the time after the stabilization of the quartz oscillator circuit 414 till the generation of an output pulse SD from the quartz oscillator circuit 414. In response to the reset-release signal SR, the first counter 423 and the second counter 425 respectively start counting of the output pulse SD supplied from the quartz oscillator circuit 414.

When an oscillating pulse SD corresponding to the predetermined number (m) from the quartz oscillator circuit 414 is counted by the first counter 423, the first counter 423 outputs an output signal S1. In response to the signal S1, the periodic counting data circuit 429 starts counting of an output pulse SH supplied from the second oscillator circuit 435. When the second counter 425 counts an oscillating pulse SD corresponding to the number (n) set by the present switch 431, the second counter 425 generates an output signal S2. In response to the signal S2, the periodic counting data circuit 429 terminates counting of the output pulse SH supplied from the second oscillator circuit 435. The counting time after the start of the counting till the counting termination corresponds to a reference time (ΔT).

An output signal S2 generated from the second counter 425 is also input into the reference pulse generator 437 and the main counter circuit 439, so each of their circuits starts counting in response to the signal S2. The reference pulse generator 437 outputs an output pulse SI for each ΔT setting itself at a initial counting state and the main counter circuit 439 counts the pulse SI. When the main counter circuit 439 counts the output pulse SI by the number (N) preset by the preset switch 441, the main counter circuit 439 outputs a detonation trigger signal SJ. Next, the electronic switching circuit 421 is triggered by the trigger signal SJ to form a switching circuit, so that the electrical energy stored in the capacitor 419 is discharged. Thus, a delay time interval T after the input of the energy sent from the blasting machine till the output of the trigger signal SJ is given by the following equation assuming that the time after the input of the energy sent from the blasting machine till the output of the reset signal SR is tr.

$$T=tr+(n\times t)+(\Delta T\times N) \tag{2}$$

As is understood from this equation, the delay time T is determined by the setting (431) of the second counter 425 and the setting (441) of the main counter circuit 439.

Further, the present embodiment is structurally resistant to explosion since the pulse of the second oscillator circuit 435 is counted in detonation. Further, time delays in the detonators connected to the same blasting machine can be set every ΔT according to the number set by the preset switch 441 of the main counter circuit 439. Since the thus-set delay times are corrected or calibrated by the quartz oscillator circuit 414, they can be all maintained at the same accuracy as that when the quartz oscillator circuit is used, even if the aforementioned second oscillator circuit is used.

Fourth Embodiment

A fourth embodiment of the present invention will now be described with reference to FIGS. 11 through 14. Incidentally, the present embodiment shows an embodiment corresponding to the paragraph (7) of the first basic mode of the present invention.

The principle of the present invention will first be described to provide easy understanding of the present embodiment.

(1) In the present embodiment, a desired delay time T is produced by generating a time interval Tk1 by M times and generating a time interval Tk2 by N times in which the interval Tk2 is longer than the time interval Tk1. That is, the present embodiment makes use of the fact that an error of the desired delay time given by the following equation is smaller than an error of a desired delay time T produced by generating only the time interval Tk1 equal to the minimum ignition time interval J times.

$$T=(Tk2\times N)+(Tk1\times M) \tag{3}$$

Namely, the present embodiment takes advantage of the fact that since the relations in the inequality of $M+N<J$ are established, an error produced in the delay time T, i.e., a cumulative counting error is given by the following inequality assuming that the counting error every counting is represented as $\Delta t$:

$$\Delta t\cdot(M+N)<\Delta t\cdot J \tag{4}$$

In practice, the delay time T of the present embodiment can be achieved by continuously counting a time interval N times using a timer whose time interval is set to Tk2, and continuously counting a time interval M times immediately after the Nth counting using a timer whose time interval is set to Tk1. Further, the timer whose time interval is Tk2 and the timer whose time interval is Tk1 are respectively composed of, for example, a CR oscillator circuit, a latch circuit and a counter.

(2) The CR oscillator circuit of each timer constructed in this way is calibrated in advance by a timer composed of one quartz oscillator circuit high in accuracy as compared with the CR oscillator circuit, and a counter. This timer is first used for calibration of the CR oscillator circuit and will not be used for counting after its utilization. Thus, even if the quartz oscillator circuit suffers damage due to an explosion shock of an adjacent explosive after the above calibration, the CR oscillator circuit and the like continue to operate without damage and the detonator initiates after a lapse of a delay time.

(3) The time interval Tk2 is determined by the number of generating times N of time interval Tk2, the desired maximum delay time Tmax, and the number of generating times M of the time interval Tk1 obtained from N. Namely, the time interval Tk2 is selected from the binary power number ($2^x$) such that cumulative counting error calculated using N and M become minimum. Where M is given as, $$M=\{Tmax-(Tk2\times N)\}/Tk1 \tag{5}$$

For example the time interval Tk2 is regarded as 64 ms when Tmax and Tk1 are respectively set as 8,191 ms and 1 ms in order to that the cumulative counting error is brought to the minimum.

Figure 11:
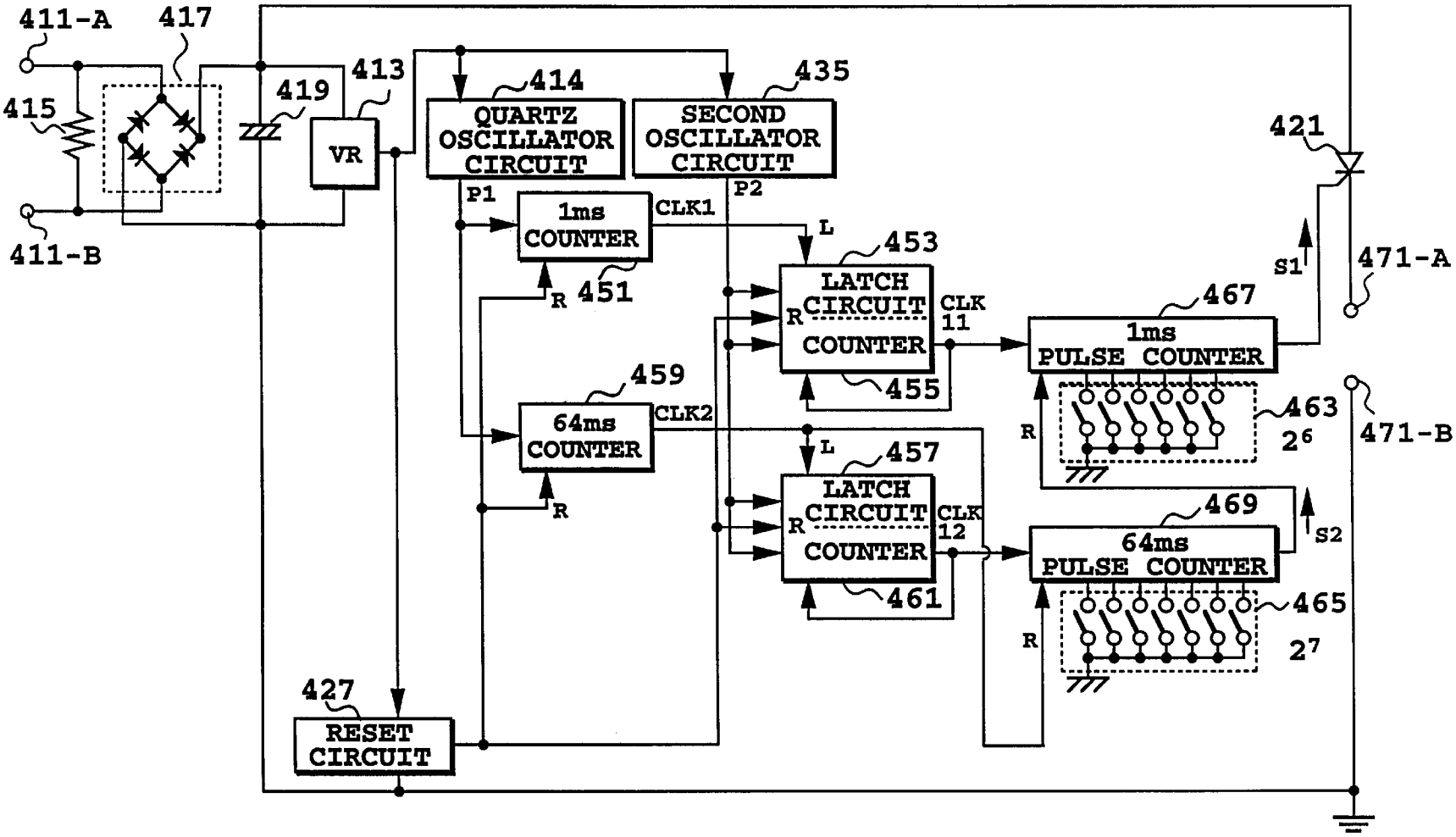
FIG. 11 is a circuit diagram showing an example of another configuration of the IC timer of FIG. 3.
Figure 12:
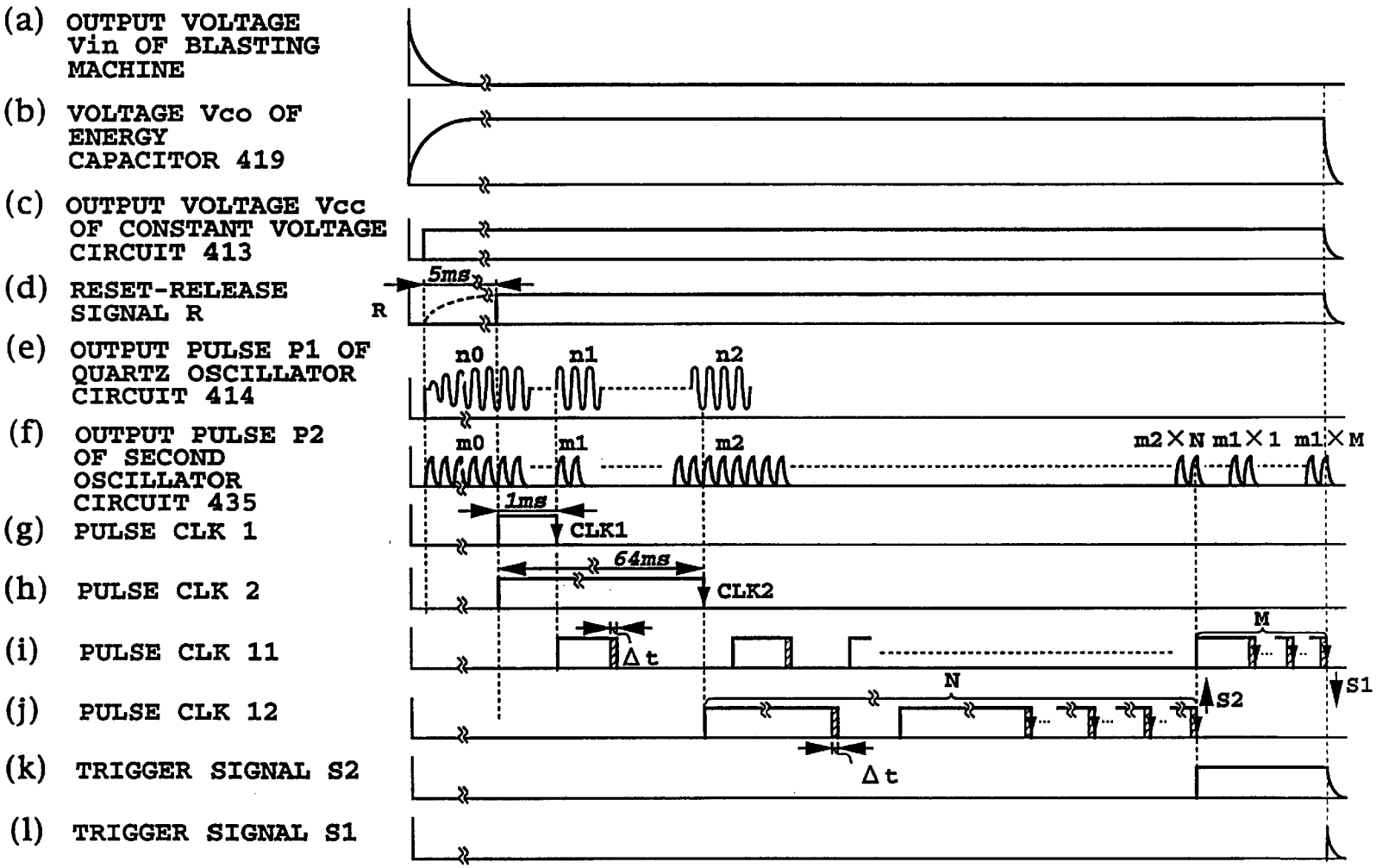
FIG. 12 is a timing chart for describing examples of timing at respective parts shown in FIG. 11.

The present embodiment will be described below with reference to the accompanying drawings. FIG. 11 shows one example of an internal configuration of an IC timer according to the present invention. The IC timer is configured so as to have the same arrangement as that shown in FIG. 3 and is driven by a voltage outputted from a constant voltage circuit 413. FIG. 12 is a timing chart for describing the operation of the IC timer shown in FIG. 11.

In FIG. 11, reference numerals 411-A and 411-B respectively indicate input terminals, which are used to receive electrical energy supplied from a blasting machine (not shown). Reference numeral 415 indicates a by-pass resistor, which is connected between the input terminals 411-A and 411-B, and used to bypass a stray current. Reference numeral 417 indicates a diode bridge circuit which serves so as to apply a predetermined polar voltage to an energy capacitor 419 regardless of the polarity of a DC voltage applied between the input terminals 411-A and 411-B and to prevent a current from flowing back from the energy capacitor 419 to the input terminals 411-A and 411-B. Reference numeral 413 indicates the constant voltage circuit which uses with the energy capacitor 419 as a power supply, and outputs predetermined constant power.

Reference numeral 414 indicates a quartz oscillator circuit whose oscillating frequency is 3 MHz, for example. Reference numeral 451 indicates a 1 ms counter, which counts a pulse P1 supplied from the quartz oscillator circuit 414 by the number equivalent to 1 ms (minimum ignition time interval) after having been reset-released by a reset circuit 427 and outputs a pulse signal CLK1 upon count-up. Reference numeral 459 indicates a 64 ms counter, which counts the pulse P1 supplied from the quartz oscillator circuit 414 by the number corresponding to 64 ms after having been reset-released by the reset circuit 427 and outputs a pulse signal CLK2 upon count-up.

Reference numeral 435 indicates a second oscillator circuit whose oscillating frequency is roughly the same as that of the quartz oscillator circuit 414. The second oscillator circuit 435 may be one which is larger in impact strength and is resistible to a blasting shock of some adjacent explosives. As such an oscillator circuit, there may preferably be an oscillator circuit using such as a CR oscillator circuit, a ring oscillator, an LC oscillator circuit or the like, or an oscillator circuit or the like using a negative resistance of a PUT (Programmable unijunction transistor) or the like.

Reference numeral 453 indicates a latch circuit, which starts counting of a pulse P2 supplied from the oscillator circuit 435 when the latch circuit is released from the reset state by the reset circuit 427 and latches therein the count value at the time when the pulse signal CLK1 has been input from the 1 ms counter 451. Reference numeral 455 indicates a counter, which counts the pulse P2 supplied from the second oscillator circuit 435 by the number latched in the latch circuit 453. Further, the counter 455 outputs a pulse signal CLK11 at count-up and repeats a self-resetting cycle. Reference numeral 457 indicates a latch circuit which starts counting of the pulse P2 supplied from the second oscillator circuit 435 when it is reset-released by the reset circuit 427 and latches the count value up to now when the pulse signal CLK2 has been input from the 64 ms counter 459. Reference numeral 461 indicates a counter, which counts the pulse P2 supplied from the second oscillator circuit 435 by the number latched in the latch circuit 457. Further, the counter 461 outputs a pulse signal CLK12 at count-up and repeats a self-resetting cycle.

Reference numeral 467 indicates a 1 ms pulse counter, which counts the pulse signal CLK11 supplied from the counter 455 by the number set by a 6-digit (binary-number) preset switch 463 and outputs a pulse signal S1 at count-up. Reference numeral 469 indicates a 64 ms pulse counter which counts the pulse signal CLK12 supplied from the counter 461 by the number set by a 7-digit (binary-number) preset switch 465 and outputs a pulse signal S2 as a reset-release signal to the 1 ms pulse counter 467 at count-up. The 64 ms pulse counter 469 is reset-released by the pulse signal CLK2.

Reference numerals 471-A and 471-B indicate output terminals to which igniting resistance wires (not shown) are electrically connected. Reference numeral 421 indicates a thyristor, which is connected in parallel with the energy capacitor 419 via the output terminals 471-A and 471-B and is turned on in response to a pulse signal S1 supplied from the 1 ms pulse counter 467. Although not shown in the drawing, the constant voltage circuit 413 is electrically connected to the respective parts of FIG. 11 excluding the thyristor 421 so that the output voltage of the constant voltage circuit 413 is applied to the parts.

The operation of the IC timer will now be described. When the blasting machine starts operation in a state in which the blasting machine has been connected between the input terminals 411-A and 411-B and the igniting resistance wires have been connected between the output terminals 471-A and 471-B, the DC voltage (see FIG. 12(*a*)) is applied across the energy capacitor 419 and simultaneously supplied to the thyristor 421 via the igniting resistance wires connected between the output terminals 471-A and 471-B. When a constant voltage is outputted from the constant voltage circuit 413 at timing shown in FIG. 12(*c*), the constant voltage is supplied to the respective parts shown in FIG. 11.

As a result, the quartz oscillator circuit 414 and the second oscillator circuit 435 start oscillating (see FIGS. 12(*e*) and 12(*f*)). Next, the 1 ms counter 451, the 64 ms counter 459 and the latch circuits 453 and 457 are released from the reset state by the reset circuit 427 after, for example, 5 ms have elapsed since the constant voltage circuit 413 outputs the constant voltage (see FIG. 12(*d*)).

When the 1 ms counter 451 and the 64 ms counter 459 are released from the reset state, they respectively start counting of the pulse P1 supplied from the quartz oscillator circuit 414. On the other hand, when the latch circuit 453 and the latch circuit 457 are released from the reset state, they respectively start counting of the pulse P2 supplied from the second oscillator circuit 435.

Further, when the 1 ms counter 451 counts up, the 1 ms counter 451 outputs the pulse CLK1 to the latch circuit 453 (see FIG. 12(*g*)) and stops its self-counting. The latch circuit 453 supplied with the pulse CLK1 stops the counting operation of the counter 455, and latches the count value at the time of the count stop. Further, the latch circuit 453 sets the latched value to the counter 455 and releases the counter 455 from the reset state.

On the other hand, when the 64 ms counter 459 counts up, it outputs the pulse CLK2 to the latch circuit 457 (see FIG. 12(*h*)), releases the 64 ms counter 469 from the reset state, and also stops its self-counting. The latch circuit 457 supplied with the pulse CLK2 stops the counting operation of the counter, and latches the count value at the time of the count stop. Further, the latch circuit 457 sets the latched value to the counter 461 and releases the counter 461 from the reset state. Accordingly, the counter 455 and the counter 461 are subsequently operated as a 1 ms counter and a 64 ms counter, respectively. When the counters 455 and 461 are released from the reset state, they respectively start counting of the pulse P2 supplied from the oscillator circuit 435.

Further, the counter 455 outputs the pulse CLK11 to the 1 ms pulse counter 467 with each count-up (see FIG. 12(*i*)). Since, however, the 1 ms pulse counter 467 is not yet released from the reset state, the pulse CLK11 is not counted by the 1 ms pulse counter 467.

On the other hand, the counter 461 outputs the pulse CLK12 to the 64 ms pulse counter 469 with every count-up (see FIG. 12(*j*)) so that the output pulse CLK12 is counted by the 64 ms pulse counter 469 which has already been released from the reset state. Next, when the 64 ms counter 469 counts up, the 64 ms pulse counter 469 outputs the trigger signal S2 (see FIG. 12(*k*)) to the 1 ms pulse counter 467 so that the 1 ms pulse counter 467 is released from the reset state. As a result, the 1 ms pulse counter 467 starts counting of the pulse CLK11 supplied from the counter 455. Thereafter, the 1 ms pulse counter 467 counts up, and applies the trigger signal S1 (see FIG. 12(*l*)) to the gate of the thyristor 421.

When the trigger signal S1 is applied to the gate of the thyristor 421, the thyristor 421 is turned on so that the energy capacitor 419 is discharged via the thyristor 421 and the igniting resistance wire connected between the output terminals 471-A and 471-B. Thus, the energy of the energy capacitor 419 is converted into thermal energy by the igniting resistance wire.

Incidentally, the preset time to be actually set in the preset switches 463 and 465 becomes a value obtained by subtracting a time after the output of the constant voltage from the constant voltage circuit 413 till the reset-release of 64 ms counter 459, and a time after the reset release till the output of the pulse CLK12 from a desired delay time interval. After 5 ms have elapsed, for example, each of the 1 ms counter 451, the 64 ms counter 459 and the latch circuits 453, 457 is released from the reset state by the reset circuit 427. When 64 ms have elapsed after the release of them from the reset state till output of the pulse CLK12, the preset time to be set reaches a value obtained by subtracting (5 ms+64 ms) from a desired delay time.

(1) The oscillating frequency of the oscillator circuit 435 will be defined as 3 MHz±20% (period: $0.33\times10^{-6}$ sec±20%). Namely, when the time interval Tk1 is 1 ms and the time interval Tk2 is 64 ms in the present embodiment, the setable maximum time (excluding a reset holding time) is obtained by the 6-digit (binary-number) preset switch 463 and the 7-digit (binary-number) preset switch 465 as follows:

$$2^{13}-1=8191 \text{ ms}$$

When the delay time is set to the maximum time interval, the 64 ms pulse counter 469 counts the output pulse CLK12 of the counter 461 by 127 times, and the 1 ms pulse counter 467 counts the output pulse CLK11 of the counter 455 by 63 times so that the maximum time interval is created. When the output pulse CLK12 of the counter 461 is counted 127 times by the 64 ms pulse counter 469 and assuming the counting error $\Delta t$ is represented as $0.33\times10^{-3}$ in this case, a cumulative error $\Delta\epsilon$ is obtained as follows:

$$\Delta\epsilon=(0.33\times127+0.33\times63)\times10^{-3}=0.04+0.02=0.06 \text{ (ms)} \quad (6)$$

(2) To make a comparison with the cumulative error in the above case, another embodiment will be described hereunder, in which a time interval Tk3 in addition to the time interval Tk1 and the time interval Tk2 is used as a fixed time interval.

Figure 13:
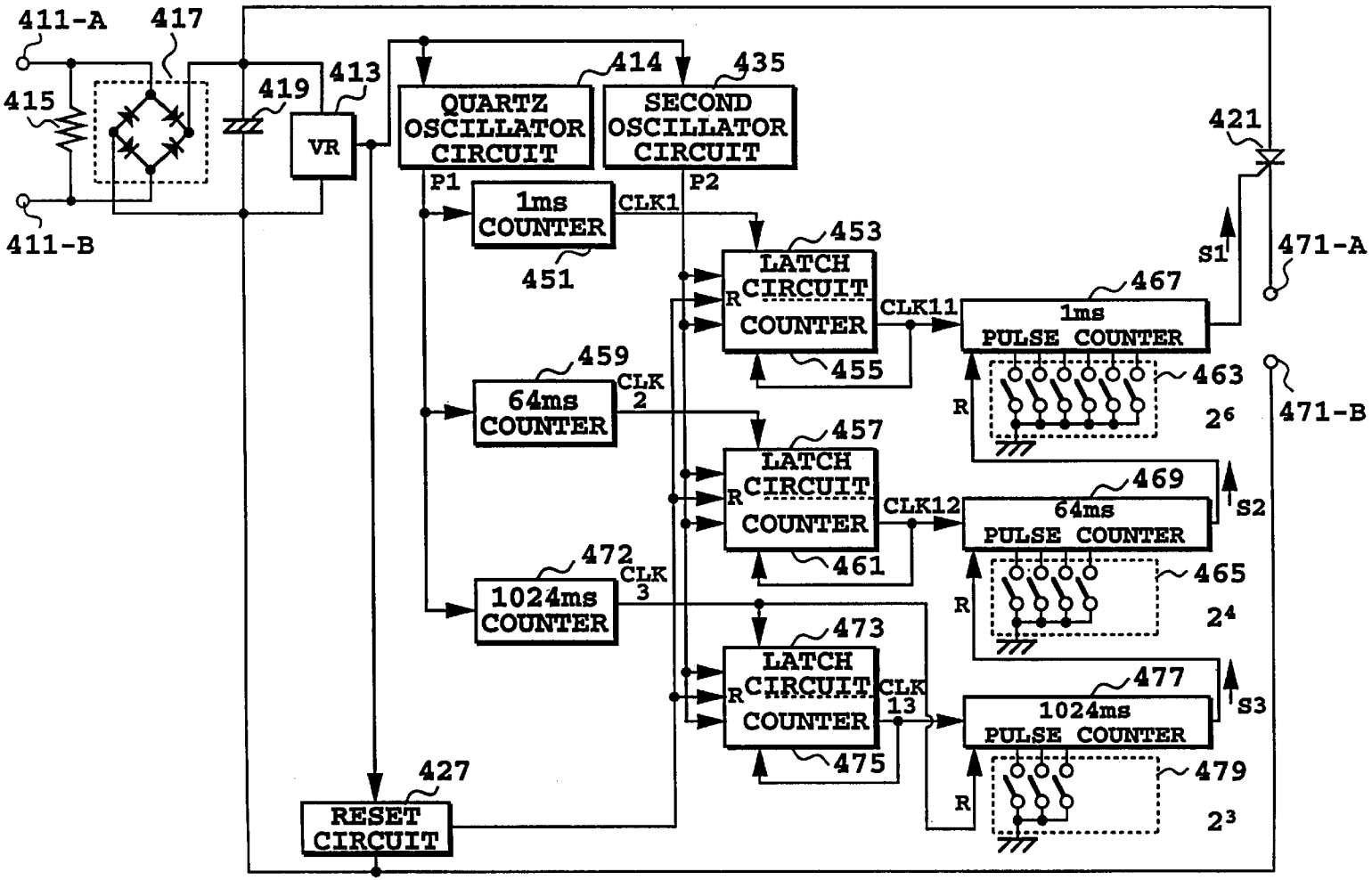
FIG. 13 shows a modification of the IC timer shown in FIG. 11 and is a block diagram showing the structure of the modification using three fixed time intervals.

In an electronic delay detonator according to the preset embodiment, as shown in FIG. 13, a 1024 ms counter 472, a latch circuit 473, a counter 475 and a 1024 ms pulse counter 477 are further included in the electronic delay detonator according to the aforementioned embodiment. Since the additionally-provided components for correction are essentially not different in operation from the 64 ms counter 459, the latch circuit 457, the counter 461 and the 64 ms pulse counter 469 employed in the aforementioned embodiments respectively except that a 64 ms pulse counter 469 is released from the reset state by a pulse S3 outputted from the 1024 ms pulse counter 477, the 1024 ms pulse counter 477 is released from the reset state by a pulse CLK3 supplied from the 1024 ms counter 472, and the digits setable by preset switches 463, 465 and 479 are respectively six digits (binary number), four digits (binary number) and three digits (binary number), then their detailed description will be omitted.

When the time intervals Tk1, Tk2 and Tk3 are respectively represented as 1 ms, 64 ms and 1024 ms, a delay time interval of 8191 ms is produced by counting an output pulse CLK13 of the counter 475 seven times by the 1024 ms pulse counter 477, counting an output pulse CLK12 of a counter 461 fifteen times by the 64 ms pulse counter 469, and counting an output pulse CLK11 of a counter 455 sixty three times by a 1 ms pulse counter 467.

Similarly to above, when the counting error $\Delta t$ is represented as $0.33\times10^{-3}$, the cumulative error $\Delta\epsilon$ is given by the following equation:

$$\Delta\epsilon=(0.33\times7+0.33\times15+0.33\times63)\times10^{-3}=0.002+0.005+0.02=0.027 \text{ (ms)} \quad (7)$$

Figure 14:
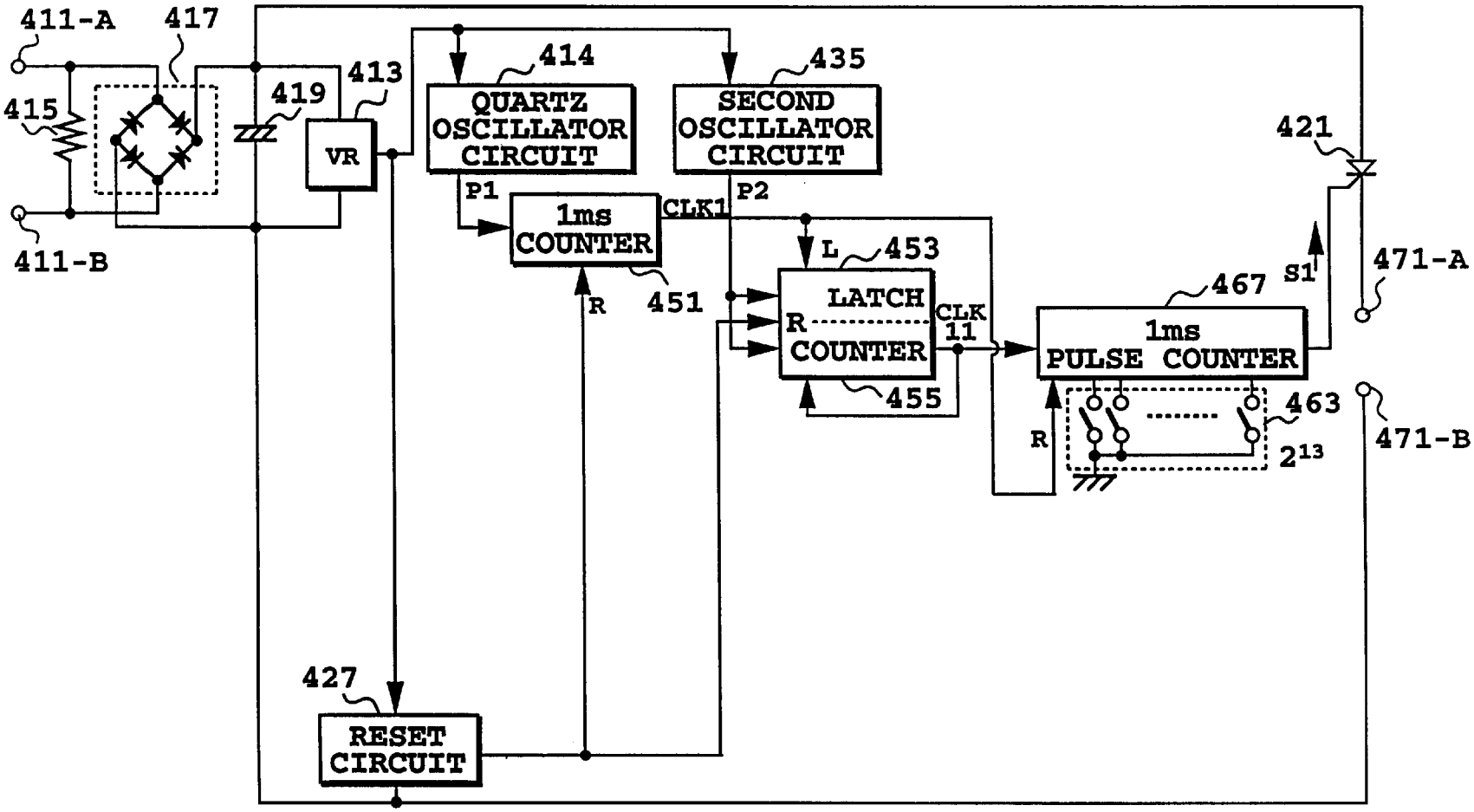
FIG. 14 illustrates another modification of the IC timer shown in FIG. 11 and is a block diagram showing the structure of the modification using only one fixed time interval.

(3) For reference purposes, a comparative example will be described in which only the time interval Tk1 is used as the fixed time interval. In an electronic delay detonator according to this reference example, the 64 ms counter 459, the latch circuit 457, the counter 461 and the 64 ms pulse counter 469 are omitted from the construction of the electronic delay detonator according to the aforementioned embodiment, as shown in FIG. 13. Thus, the present electronic delay detonator is configured as shown in FIG. 14.

Similarly to above, when the counting error $\Delta t$ is represented as $0.33\times10^{-3}$, then the cumulative error $\Delta\epsilon$ is given by the following equation:

$$\Delta\epsilon=0.33\times8191\times10^{-3}=2.70 \text{ (ms)} \quad (8)$$

The overall counting error in the aforementioned paragraphs (1), (2) and (3) will be summarized as presented in Table 6 shown below. It is understood from Table 6 that the cumulative counting error is reduced as the number of the fixed time intervals increases in order of 1, 2 and 3. Particularly when the number of the fixed time intervals is two, the cumulative counting error is greatly reduced as compared with the case where the number of the fixed time intervals is one.

Thus, the present embodiment show that it can offer strong resistance to the blasting shock and provide less reduction in variation of the delay time. It is therefore possible to perform more high-accuracy ignition time control.

Further, using the IC timer according to the present embodiment, which is added with the aforementioned functions, an HIC module is configured in accordance with FIGS. 3 and 4 in a manner similar to the aforementioned first embodiment of the present invention. The HIC module is inserted into the stainless steel-made metal housing 213 (whose outer diameter and thickness are respectively 15 mmø and 1.5 mm) as shown in FIG. 5A in a manner similar to the first embodiment. In this condition, the resin is charged into the metal housing 213 so that the resin layer 211 is formed. The two-part epoxy compounded resin (Trade Name: TB2023 (Chief Material)/TB2105F (Curing Agent) manufactured by Three Bond Company) which has a slow hardening property and flexibility, was used as the resin to be charged into the housing.

In the present electric detonator 200, as shown in FIG. 5A, the ignition charge 223 was provided around the ignition resistance wire 221. The primary explosive 215 was inserted between the inner shell 231-1 and an inner shell 231-2 neighboring to a space 229 extending from the ignition charge layer 223 and the base charge 217 was charged into the bottom of the detonator 200.

A blasting shock test was effected in water on the electronic delay detonator constructed as described above while its structure and the condition of the blasting shock test were being changed in various ways. A slurry explosive (100 g: inch size explosive in diameter) was used as the source of generation of the blasting shock and was placed at a depth of 2 m under water with samples placed at a predetermined distance away from the slurry explosive. Further, the distance was changed in various forms and the type of sample was changed variously.

The result of the blasting shock test will be presented in Table 7 shown below. According to the result of Table 7, it is understood that the operating range of the electronic timer can be enlarged without reducing the accuracy of the ignition time and hence a misfire can be avoided.

TABLE 6

| | Number of Counting reference time interval | Counting reference time × number of counts at maximum delay time interval | | | Counting error at one count | Δt × number of counts (ms) | Overall accuracy |
|---|---|---|---|---|---|---|---|
| | | Tk1 | Tk2 | Tk3 | Δt (ms) | | |
| Comparative example | 1 | 1 ms × 8191 | — | — | $0.33\times10^{-3}$ | 2.70 | 2.70 ms ± 20% |
| Embodiment | 2 | 64 ms × 127 | 1 ms × 63 | — | $0.33\times10^{-3}$ | 0.04 + 0.02 | 0.06 ms ± 20% |
| | 3 | 1024 ms × 7 | 64 ms × 15 | 1 ms × 63 | $0.33\times10^{-3}$ | 0.002 + 0.005 + 0.02 | 0.027 ms ± 20% |

TABLE 7

| Space length (mm) from ignition change layer to primary explosive layer | Quartz oscillator Type | Crystal size (mm) Overall length T | Width A | Thickness | T/A | Operating conditions of electronic timer according to shock distance (number of normal detonation/number of experiments) 15 cm | 25 cm | 35 cm | 45 cm | 75 cm |
|---|---|---|---|---|---|---|---|---|---|---|
| 4 | AT | 7.0 | 1.7 | 0.1–0.4 | 4.1 | 0/6 *6/6 SD | 0/6 *6/6 SD | 5/6 *1/6 SD | 6/6 | 6/6 |
| 0 | AT | 7.0 | 1.7 | 0.1–0.4 | 4.1 | 0/6 *6/6 SD | 4/6 *2/6 SD | 6/6 | 6/6 | 6/6 |

Note): Ignition time error:within ± 1 ms
*: Failure mode
SD: Sympathetic detonation
CD: Crystal destruction

Fifth Embodiment

Figure 15:
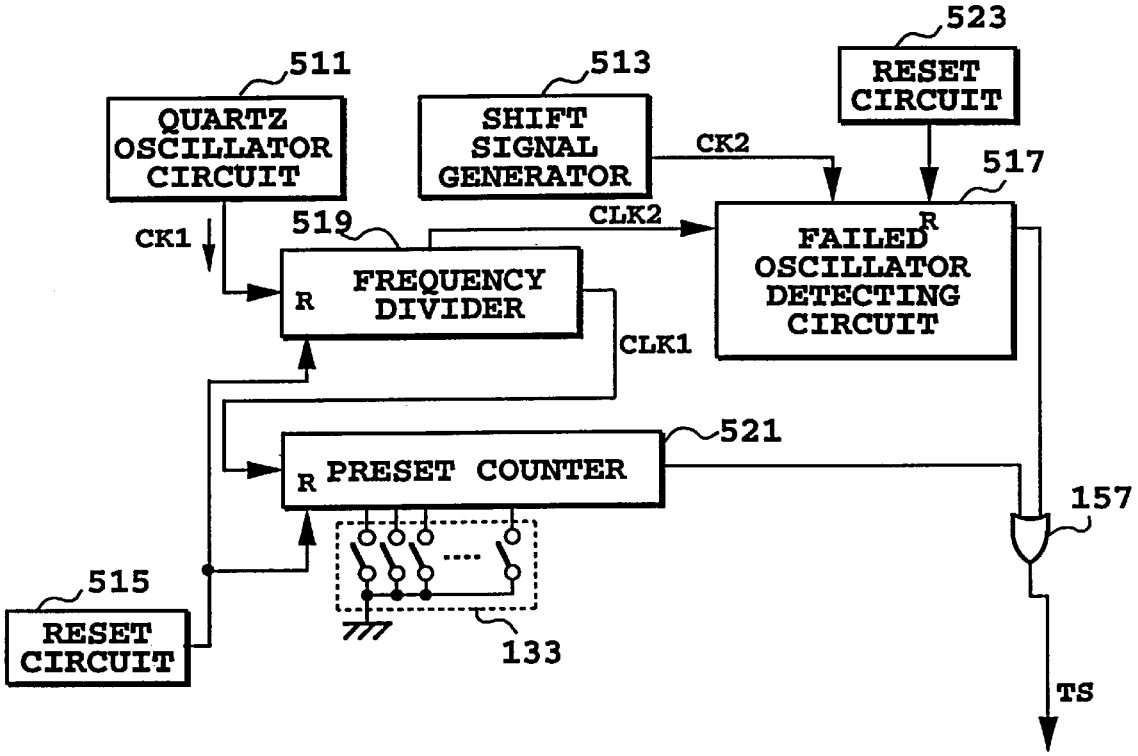
FIG. 15 is a block diagram illustrating a further example of the configuration of the IC timer of FIG. 3.

A fifth embodiment of the present invention will now be described with reference to FIG. 15. Incidentally, the present embodiment corresponds to the paragraph (1) of the aforementioned third basic mode of the present invention. FIG. 15 illustrates a further example of the internal configuration of the IC timer according to the present invention. The IC timer is connected in the same layout as IC timer 130 shown in FIG. 3 and is driven at the output voltage of the constant voltage circuit 121. As shown in FIG. 15, the preset timer IC comprises a quartz oscillator circuit 511, a shift signal generator 513, a reset circuit 515, a failed oscillator detecting circuit 517, a frequency divider 519, a preset counter 521, a reset circuit 523 and an OR circuit 157.

As the oscillator circuit of the shift signal generator 513, there may preferably be an oscillator circuit using a resonance phenomenon of a CR oscillator circuit, a ring oscillator, an LC oscillator circuit or the like, or an oscillator circuit using a negative resistance of a PUT or the like.

A counting reference clock of the timer employed in the present embodiment is produced by the quartz oscillator circuit 511. A pulse CK1 outputted from the quartz oscillator circuit 511 is sent to the frequency divider 519. After the frequency divider 519 has been released from the reset state by the reset circuit 515, the frequency divider 519 frequency-divides the pulse CK1 and output clock signal CLK2 for detecting a quartz oscillating operation and clock signal CLK1 for counting.

The preset counter 521 is released from the reset state by the reset circuit 515 and thereafter counts the above counting clock signal CLK1 by the number preset by a preset switch 133. After completion of the counting, the preset counter 521 outputs a trigger signal TS through the OR circuit 157. The trigger signal TS is supplied to an electronic switching device 140 (see FIG. 3) provided outside the IC timer 130 to form a switching circuit (not shown). On the other hand, the clock signal CLK2 is sent to the failed oscillator detecting circuit 517.

The failed oscillator detecting circuit 517 is released from the reset state by the reset circuit 523 and thereafter always monitors the presence or absence of the pulse CLK2 supplied from the frequency divider 519. When the pulse CLK2 is fixed to either a low level or a high level, the failed oscillator detecting circuit 517 forcibly outputs a trigger signal TS via the OR circuit 157 immediately so as to form an external switching circuit. Further, the failed oscillator detecting circuit 517 may be composed of a pulse charging circuit (not shown) and a logical circuit (not shown) for determination of a charging voltage level, for example. The pulse charging circuit is repeatedly charged in response to the pulse signal CLK2. When the supply of the charging pulse is stopped, the pulse charging circuit is charged or discharged to a source voltage VCC or a zero voltage level (GND level).

The failed oscillator detecting circuit 517 may comprise a multistage shift register circuit (not shown) (such as 10-stage to 16-stage shift register circuits) and a logical circuit (not shown) for detecting the coincidence concerning values of the registers. In this case, the shift register circuit takes in the potential of the signal CLK2 in response to a shift signal supplied from the shift signal generator 513 and shifts the potential to the next-stage register. The coincidence detection logical circuit always decides whether the outputs of the respective registers are all fixed to either a low level or a high level during a predetermined failure detection time ΔT. In the present embodiment, the 16-stage shift register circuit is used.

Further, using the IC timer 130 according to the present embodiment, which is added with the aforementioned functions, an HIC module is configured in accordance with FIGS. 2 and 3 in a manner similar to the aforementioned first embodiment of the present invention. The HIC module is inserted into the stainless steel-made metal housing 213 (whose outer diameter and thickness are respectively 15 mmø and 1.5 mm) as shown in FIG. 5A in a manner similar to the first embodiment. In this condition, the resin is charged into the metal housing 213 so that the resin layer 211 is formed. The two-part epoxy compounded resin (Trade Name TB2023 (Chief Material)/TB2105F (Curing Agent) manufactured by Three Bond Company) which has a slow hardening property and flexibility, was used as the resin to be charged into the housing.

In the present electric detonator 200, as shown in FIG. 5A, the ignition charge 223 was provided around the ignition resistance wire 221. The primary explosive 215 was inserted between the inner shell 231-1 and an inner shell 231-2 and the base charge 217 was charged into the bottom of the detonator 200.

(1) A blasting shock test was effected in water on the electronic delay detonator constructed as described above while its structure and the condition of the blasting shock test were being changed in various ways. A slurry explosive (100 g: inch size explosive in diameter) was used as the source of generation of the blasting shock and was placed at a depth of 2 m under water with samples placed at a predetermined distance away from the slurry explosive. Further, the distance was changed in various forms and the type of sample was changed variously.

The result of the blasting shock test will be presented in Table 8 shown below. According to the result of Table 8, it is understood by reference to the result of Table 2 described above that the electronic delay detonator is self-detonated (induced-detonated) in a shock-value range in which the quartz oscillator produces damage.

(2) A blasting shock test was effected in sand on the electronic delay detonator according to the present embodiment, which has the same structure as described above while its structure and the condition of shock test were being changed in various ways. A shock that the electronic delay detonator undergoes in sand, is assumed to correspond to two cases: one in which the electronic delay detonator is expelled by vibrations in an elastic range of rock so that displacement acceleration is produced; and the other in which explosive gas enters through a crack of rock so that compression applied from one direction or displacement acceleration is produced.

The blasting shock test was carried out as follows: A slurry explosive (100 g: inch size explosive in diameter) was used as the source of generation of the blasting shock and was placed at a depth of 80 cm in sand with samples placed at a predetermined distance away from the slurry explosive. Further, the distance was changed in various forms and the type of sample was changed variously.

The result of the blasting shock test will be presented in Table 9 shown below. It has been found that no sympathetic detonation occurs in sand till a distance of 10 cm as seen from the sample explosive. Thus, according to the result of Table 9, it is understood that the electronic delay detonator is subjected to induced detonation (self detonation).

TABLE 8

| Space length (mm) from ignition charge layer to primary explosive layer | Quartz oscillator: Type | Crystal size (mm): Over-all length T | Width A | Thick ness | T/A | Operating conditions of electronic timer according to shock distance (number of normal/number of experiments): 15 cm | 25 cm | 35 cm | 45 cm | 75 cm |
|---|---|---|---|---|---|---|---|---|---|---|
| 0 | AT | 7.0 | 1.7 | 0.1–0.4 | 4.1 | 0/6 *6/6 SD | 0/6 *4/6 SD *2/6 SL | 0/6 *6/6 SL | 1/6 *5/6 SL | 6/6 |
| 0 | Tuning fork | 4.5 | 1.0 | 0.2 | 4.5 | 0/6 *6/6 SD | 0/6 *4/6 SD *2/6 SL | 0/6 *6/6 SL | 1/6 *5/6 SL | 6/6 |
| 0 | Tuning fork | 3.5 | 0.9 | 0.3 | 3.9 | 0/6 *6/6 SD | 0/6 *4/6 SD *2/6 SL | 1/6 *5/6 SL | 2/6 *4/6 SL | 6/6 |
| 0 | Tuning fork | 3.5 | 1.0 | 0.2 | 3.5 | 0/6 *6/6 SD | 0/6 *4/6 SD *2/6 SL | 6/6 | 6/6 | 6/6 |
| 0 | Tuning fork | 2.48 | 1.0 | 0.1 | 2.48 | 0/6 *6/6 SD | 2/6 *4/6 SD | 6/6 | 6/6 | 6/6 |

Note) *: Failure mode
SD: Sympathetic detonation
SL: Seif detonation

TABLE 9

| Space length (mm) from ignition charge layer to primary explosive layer | Quartz oscillator Type | Crystal size (mm) Over-all length T | Width A | Thick-ness | T/A | Operating conditions of electronic timer according shock distance (number of normal detonation/number of experiments) 5 cm | 10 cm | 15 cm | 25 cm |
|---|---|---|---|---|---|---|---|---|---|
| 4 | AT | 7.0 | 1.7 | 0.1–0.4 | 4.1 | 0/6 *6/6 SD | 0/6 *6/6 SL | 1/6 *5/6 SL | 6/6 |
| 4 | Tuning fork | 4.5 | 1.0 | 0.2 | 4.5 | 0/6 *6/6 SD | 0/6 *6/6 SL | 2/6 *4/6 SL | 6/6 |
| 4 | Tuning fork | 3.5 | 1.0 | 0.2 | 3.5 | 0/6 *6/6 SD | 1/6 *5/6 SL | 6/6 | 6/6 |
| 4 | Tuning fork | 2.48 | 1.0 | 0.1 | 2.48 | 0/6 *6/6 SD | 6/6 | 6/6 | 6/6 |

Note) *: Failure mode
SD: Sympathetic detonation
SL: Self detonation

Sixth Embodiment

Figure 16:
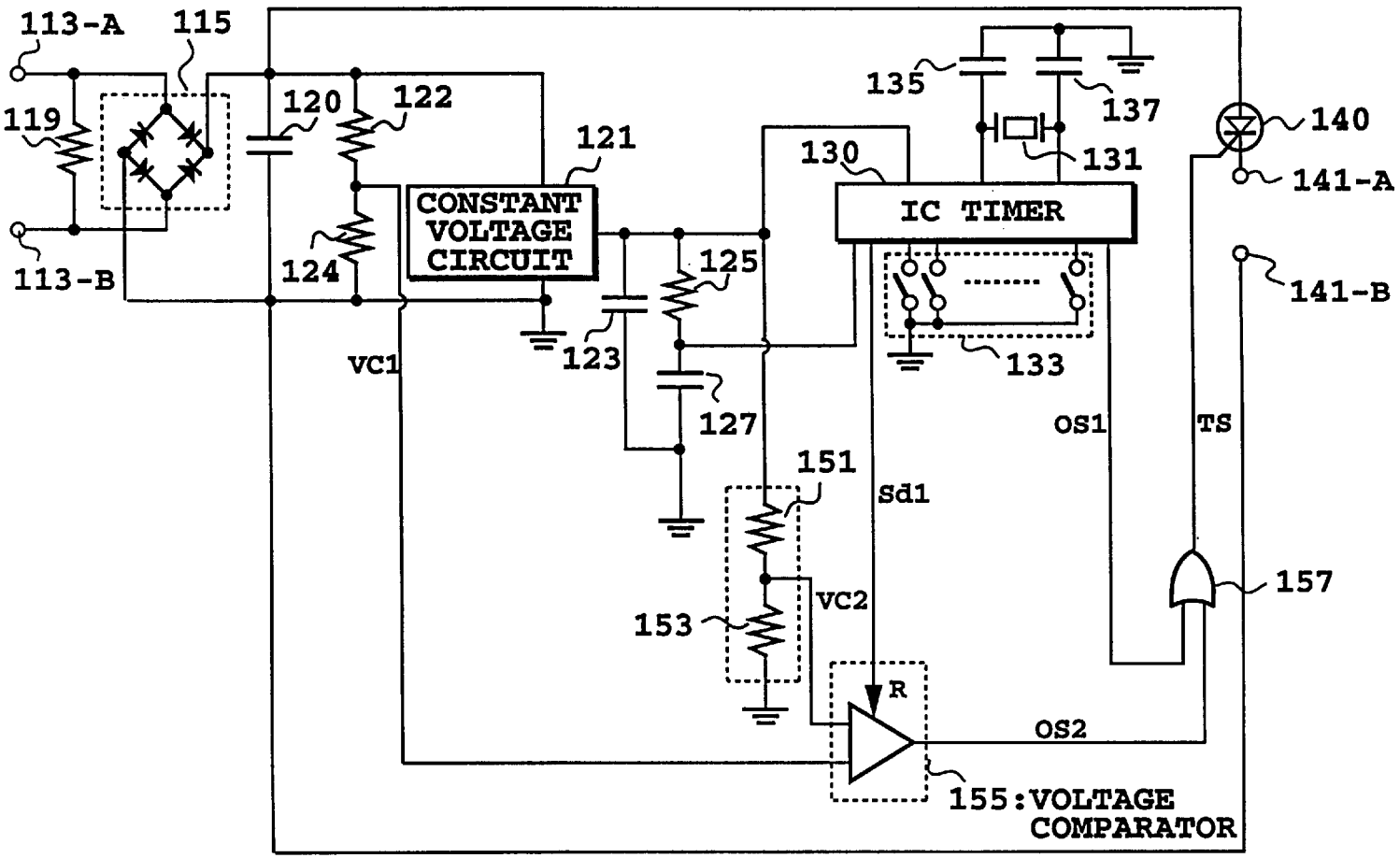
FIG. 16 is a circuit diagram showing another example of the configuration of the electronic timer employed in the electronic delay detonator according to the present invention.

A sixth embodiment of the present invention will now be described with reference to FIG. 16. Incidentally, the present embodiment corresponds to the paragraph (2) of the aforementioned third basic mode of the present invention. FIG. 16 illustrates the configuration of an HIC of the present electronic delay detonator in accordance with the sixth embodiment.

As shown in FIG. 16, in blasting, electrical energy is supplied from an electric blasting machine (not shown) to input terminals 113-A and 113-B through a leading wire and a connecting wire (neither shown) and leg wires (not shown) attached to each of detonators. A rectifier 115 is electrically connected with the input terminals 113-A and 113-B so as to match the polarity of an input energy with that of an internal circuit. An energy capacitor 120 is connected to the rectifier 115 so that bidirectional inputs can be charged by the rectifier 115. A by-pass resistor 119 is connected in parallel with the energy capacitor 120 and in parallel between the input terminals of the rectifier 115. Further, input terminals of a constant voltage circuit 121 is connected in parallel with the energy capacitor 120. Resistors 122 and 124 for detecting the voltage stored in the energy capacitor 120 are connected in parallel with the energy capacitor 120 and between the input terminals of the constant voltage circuit 121.

To an output terminal of the constant voltage circuit 121 are connected a time constant circuit for producing a rest holding time for an internal function of an IC timer 130, which is composed of a serial circuit consisting of a resistor 125 and a capacitor 127 and a filter capacitor 123 for stabilizing the output of the constant voltage circuit 121, and a power supply terminal of the IC timer 130. An output voltage of the time constant circuit is input into the IC timer 130, and then is compared with a voltage outputted from a reference voltage generating circuit (not shown) included in the IC timer 130 by a comparator (not shown) in the IC timer 130. When these two voltage levels coincide with each other, the IC timer 130 outputs a reset-release signal.

Further, the IC timer 130 comprises an oscillator circuit (not shown) using a characteristic frequency of a quartz oscillator 131 as a reference, a frequency divider (not shown) for frequency-dividing an output pulse of the oscillator circuit into reference frequency pulses each having a period of 1 ms in response to the above mentioned reset-release signal, and a counter circuit (not shown) for counting the output pulses of the frequency divider by the number determined by a switching circuit 133 and outputting a trigger signal OS1 after completion of the counting. Further, the IC timer 130 outputs the reset-release signal Sd1 to a voltage comparator 155 after a time longer than a time required to finish the charging of the energy capacitor 120 has elapsed.

A gate capacitor 135 and a drain capacitor 137 of an oscillating inverter (not shown) are connected between the quartz oscillator 131 and the ground as shown in FIG. 16. A sample voltage VC1 obtained by dividing a charged voltage VC of the energy capacitor 120 with resistors 122 and 124 is input into a comparison voltage input terminal of the voltage comparator 155. In the present embodiment, resistors 151 and 153 for generating a comparison reference voltage are connected to the output terminal of the constant voltage circuit 121. A comparison reference voltage VC2 divided by the resistors 151 and 153, is input into a reference voltage input terminal of the voltage comparator 155.

The voltage comparator 155 is released from the reset state in response to the reset-release signal Sd1 generated from the IC timer 130 so as to start comparing. When the sample voltage VC1 becomes equal to the comparison reference voltage VC2, the voltage comparator 155 outputs an output signal OS2 to an OR circuit 157.

When the maximum value Vcp of the charged voltage of the energy capacitor 120 is set to 15(V) and the output constant voltage Vconst. of the constant voltage circuit 121 is set to 3(V), for example, a voltage-division ratio between the resistors 122 and 124 is determined so as to become VC1=3(V) when Vcp=15(V). In order to output the signal OS2 from the voltage comparator 155 when the sample voltage VC1 is reduced to 60%, a voltage-division ratio between the resistors 151 and 153 is determined so as to become VC2=1.8(V) at all times. Thus, when the level of the charged voltage of the energy capacitor 120 is reduced to below 9(V), the voltage comparator 155 can be operated so as to output the signal OS2 to the OR circuit 157.

When the count end signal OS1 generated from the IC timer 130 or the signal OS2 generated from the voltage comparator 155 is input into the OR circuit 157, the OR circuit 157 outputs a trigger signal TS to an electronic switching device 140 so as to close the switching circuit 140.

In the present embodiment, the resistors 122 and 124, the voltage comparator 155 and the OR circuit 157 are provided outside the IC timer 130. However, they may be included inside the IC timer 130.

Seventh Embodiment

Figure 17:
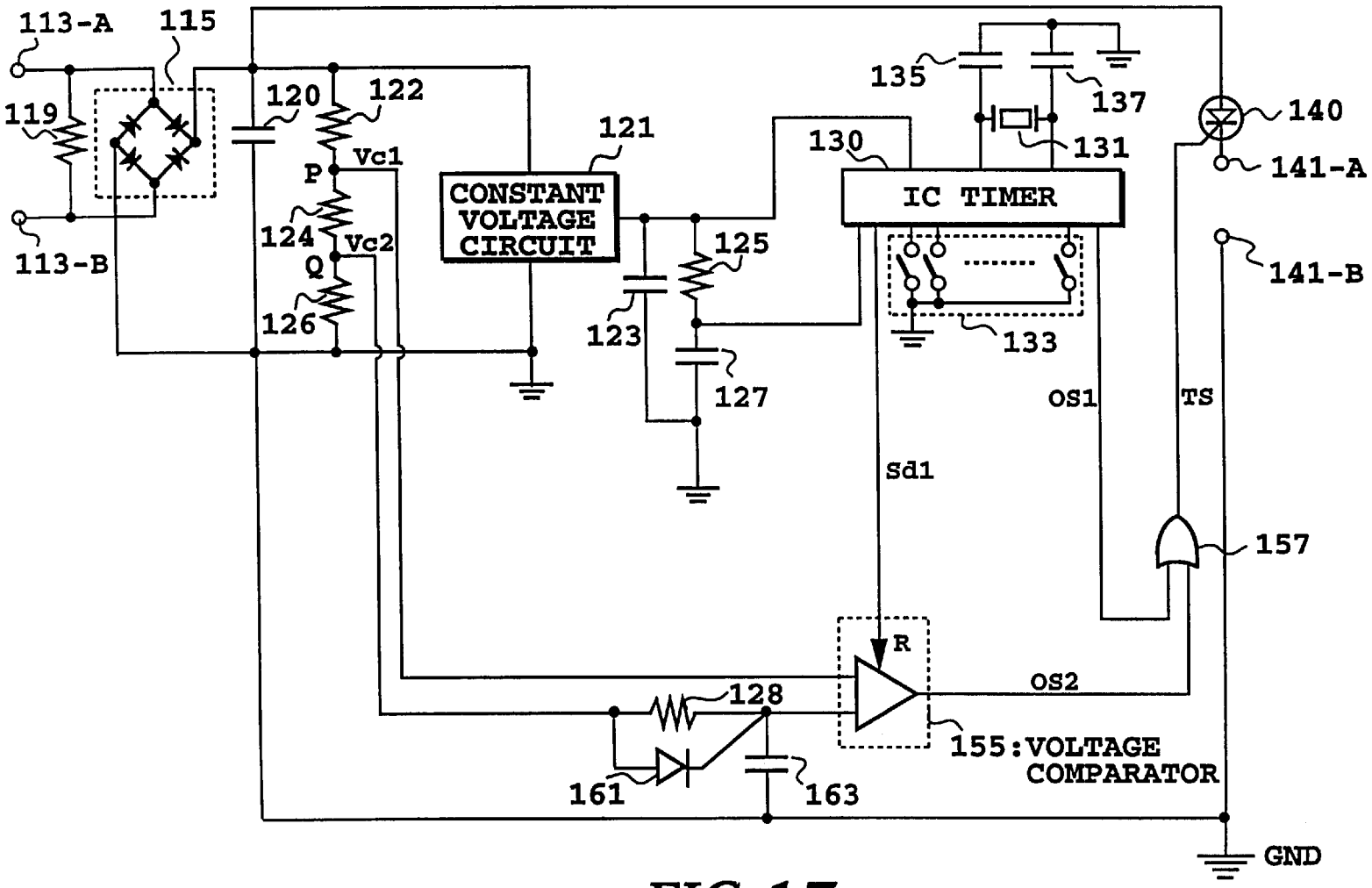
FIG. 17 is a circuit diagram illustrating a configuration of a modification of the electronic timer shown in FIG. 16.

A seventh embodiment of the present invention will now be described with reference to FIG. 17. Incidentally, the present embodiment corresponds to the paragraph (2) of the aforementioned third basic mode of the present invention. FIG. 17 illustrates the configuration of an HIC of the present electronic delay detonator according to the seventh embodiment.

As shown in FIG. 17, in blasting work, electrical energy is supplied from an electric blasting machine (not shown) to input terminals 113-A and 113-B via a leading wire and a connecting wire (neither shown) and leg wires (not shown) attached to each of detonators. A rectifier 115 is electrically connected to the input terminals 113-A and 113-B so as to match the polarity of an input with the polarity of an internal circuit. An energy capacitor 120 is connected to the rectifier 115 so that bidirectional inputs can be stored in the capacitor 120 by the rectifier 115. A by-pass resistor 119 is connected in parallel with the capacitor 120 and between the input terminals of the rectifier 115.

Further, input terminals of a constant voltage circuit 121 are connected to resistors 122 and 124 for detecting the charge voltage in parallel with the capacitor 120. With output terminals of the constant voltage circuit 121 are connected a time constant circuit for producing a reset holding time of an internal function of an IC timer 130, which is composed of a resistor 125 and a capacitor 127, and a filter capacitor 123 for stabilizing the output of the constant voltage circuit 121, and a power supply terminal of the IC timer 130.

An output voltage of the above time constant circuit is input into the IC timer 130. A comparator (not shown) provided inside the IC timer 130 compares the output voltage of the time constant circuit with a voltage outputted from a reference voltage generating circuit (not shown) provided inside the IC timer 130 as well. The IC timer 130 is provided so as to output a reset-release signal when these two voltage levels coincide with the each other.

Further, the IC timer 130 comprises an oscillator circuit (not shown) using a characteristic frequency of a quartz oscillator 131 as a reference, a frequency divider (not shown) for dividing an output pulse of the oscillator circuit into a reference frequency pulses having a period of 1 ms in response to the reset-release signal, and a counter circuit (not shown) for counting the output pulse of the frequency divider by the number determined by a switching circuit 133 and outputting a trigger signal OS1 after completion of the counting. Further, the IC timer 130 outputs the reset-release signal Sd1 to a voltage comparator 155 after a time longer than a time required to complete the charging of the energy capacitor 120 has elapsed. A gate capacitor 135 and a drain capacitor 137 of an oscillating inverter (not shown) are electrically connected to the quartz oscillator 131 as shown in FIG. 17.

In the present embodiment, the three resistors 122, 124, and 126 being in series are connected between the energy capacitor 120 and the constant voltage circuit 121 and in parallel with the capacitor 120. A comparison reference voltage VC2 obtained dividing by a charged voltage VC of the energy capacitor 120 is taken out from a point Q at which the resistors 124 and 126 are connected to each other. Further, the comparison reference voltage VC2 is input into a reference voltage input terminal of the voltage comparator 155 via a parallel circuit composed of a resistor 128 and a diode 161. A capacitor 163 is connected between the reference voltage input terminal of the voltage comparator 155 and the GND terminal.

In the present embodiment, in addition to this, a sample voltage VC1 obtained by dividing the charged voltage VC is taken out from a point P at which the resistors 122 and 124 are connected to each other, followed by direct inputting to a comparison voltage input terminal of the voltage comparator 155.

The voltage comparator 155 is released from the reset state in response to the reset-release signal Sd1 generated from the IC timer 130 and thereby starts comparing.

In the present embodiment, the current, which flows from the connecting point Q to the reference voltage input terminal of the voltage comparator 155 principally flows through the diode 161 in the process of charging the energy capacitor 120. Therefore, the setting of the capacitance of the capacitor 163 to about one hundredth through one thousandth or less of the capacitance of the capacitor 120 allows the potential at the reference voltage input terminal of the voltage comparator 155 to reach the comparison reference voltage VC2 capable of providing a comparison operation at the time substantially equal to the time required to complete the charging of the energy capacitor 120. Thus, the voltage comparator 155 is constructed so that the potential at the reference voltage input terminal reaches the comparison reference voltage VC2 capable of providing a comparison operation until the reset-release signal Sd1 is input into the voltage comparator 155 at least.

In the present embodiment, the relationship between the sample voltage VC1 and the comparison reference voltage VC2 during a normal counting operation subsequent to the completion of the charging of the energy capacitor 120 is as follows: the sample voltage VC1 becomes higher than the comparison reference voltage VC2 by a drop voltage developed across the resistor 124.

Incidentally, the consumed current used up by the IC timer 130 according to the present embodiment is less than or equal to 0.5 mA. When the capacitor 120 is composed of a capacitance of 1,000 $\mu$F, for example, a discharge voltage vs. time gradient of the capacitor 120 becomes 1 (V)/1 sec or less during a normal delay operation time.

When the electronic delay detonator according to the present invention is subjected to the aforementioned detonation shock or the like, there may be cases in which the capacitor 120 is abnormally discharged in a state in which the discharge voltage vs. time gradient of the capacitor 120 exceeds 1 V/1 sec. In such a case, namely, when the level of the charged voltage of the capacitor 120 is suddenly reduced, the sample voltage VC1 drops in proportion to the abnormal discharge of the capacitor 120. On the other hand, the comparison reference voltage VC2 at the connecting point Q drops substantially simultaneously with the sample voltage VC1. Since, however, a delay in discharging the electrical charge stored in the capacitor 163 is developed at the reference voltage input terminal by the resistor 128, the drop of the comparison reference voltage VC2 is delayed by a predetermined time from the time when the sample voltage VC1 drops. At this time, there is established an inverse relationship between the sample voltage VC1 and the comparison reference voltage VC2 as compared with the case of the aforementioned normal counting operation. Thus, the sample voltage VC1 is momentarily reduced as compared with the comparison reference voltage VC2.

In the present embodiment, the voltage comparator 155 detects the instant at which the sample voltage VC1 becomes lower than the comparison reference voltage VC2 and thereafter outputs an output signal OS2 to the OR circuit 157.

Here, circuit constants of the resistors 122, 124, 126 and 128 and the capacitor 163 can be arbitrarily selected according to the level of the charged voltage of the capacitor 120 at the time of the detection of the abnormal discharge of the capacitor 120. When the count end signal OS1 produced from the IC timer 130 or the signal OS2 produced from the voltage comparator 155 is input into the OR circuit 157, the OR circuit 157 outputs a trigger signal TS to a switching device 140 so as to close the switching device 140.

In the present embodiment, the resistors 122, 124, 126 and 128, the diode 161, the capacitor 163, the voltage comparator 155 and the OR circuit 157 are provided outside the IC timer 130. However, they may be included inside the IC timer 130.

Industrial Applicability

According to the present invention as described above, controlled blasting based on a high-accuracy ignition time, which takes advantage of properties of the electronic timer by using the quartz oscillator or ceramic oscillator as the reference, can be performed at the normal blasting work. Even in adverse use environments, any misfire of electric detonator can be eliminated. Particularly when the form of a shock applied to the electronic delay detonator corresponds to, for example, a case in which rock is displaced by destruction so that the electronic delay detonator undergoes compression, the electronic delay detonator is expected to undergo an extremely large impact pressure. It is thus considered that the electronic delay detonator itself would be crushed. According to the present invention, detection is effected on the damage of the quartz oscillator during the difference in time developed between the damage of the quartz oscillator produced in response to the shock and the compression of the electronic delay detonator by the rock. Thus, this problem can be solved by configuring the electronic delay detonator so as to be fired in response to the detected signal. Since the much safer electronic delay detonator can be provided in this way, an increase in industrially applicable range can be expected.

The present invention has been described in detail with respect to the preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

We claim:

1. An electronic delay detonator including an electronic timer (100), and an electric detonator (200) fired by ignition of an ignition element (221), said electronic timer characterized by comprising:

an energy charging circuit (120, 419) for storing electrical energy supplied from a power supply (10);

a delay circuit (30) for determining a time period by using the electrical energy stored in said energy charging circuit to thereby output a trigger signal; and a first switching circuit (140, 421) for supplying the electrical energy stored in said energy charging circuit to said ignition element in response to the trigger signal, and characterized in that in response to an impact externally applied to said electronic delay detonator, a lower limit of an impact value in an induced detonation range of said electric detonator substantially overlaps with an upper limit of an impact value in a range in which said electronic timer is operable.

2. The electronic delay detonator as claimed in claim 1, wherein said delay circuit (30) performs a counting operation using a characteristic frequency of a quartz oscillator (131) as a reference.

3. The electronic delay detonator as claimed in claim 2, wherein a length T of a crystal of said quartz oscillator (131) is in the range of 2.0 mm to 3.5 mm, and a ratio T/A of the length T to a width A of the crystal is in the range of 2.0 to 3.5.

4. The electronic delay detonator as claimed in claim 1, wherein said delay circuit comprises:

a first oscillator circuit using a characteristic frequency of a quartz oscillator as a reference;

a second oscillator circuit having a level of impact resistance greater than that of said first oscillator;

a count period producing circuit for producing one or a plurality of count periods by using pulses of said second oscillator circuit so that a count period coincides with a reference period produced by pulses of said first oscillator circuit; and a trigger signal generating circuit for generating and outputting said trigger signal based on said count period.

5. The electronic delay detonator as claimed in claim 1, wherein a space length is provided between an ignition charge layer (223) ignited by said ignition element (221) and a primary explosive layer (215), said space length (L) ranging from 4 mm to 14 mm.

6. The electronic delay detonator as claimed in claim 1, wherein said electronic timer (100) comprises:

a malfunction detecting circuit (517, 151, 153, 157) for detecting a malfunction of circuit elements (511, 120), said malfunction occurring when the circuit element is subjected to an explosive shock, and said malfunction detecting circuit outputting a malfunction detecting signal;

a forced trigger circuit (157) for outputting a forced trigger signal in response to the malfunction detected signal; and a second switching circuit (140) for supplying the ignition element (221) with the electrical energy stored in said energy charging circuit (120) in response to the forced trigger signal.

7. The electronic delay detonator as claimed in claim 1, wherein said electronic timer (100) is housed within a cylinder (312) having impact resisting properties, and a viscoelasticity material (319) is filled into a space defined between said electronic timer and a wall of the cylinder.

8. The electronic delay detonator as claimed in claim 1, wherein said electronic timer (100) is housed within a cylinder (313) having impact resisting properties, only a periphery of said energy charging circuit (120, 419) is covered with one of a foamed resin and a gel-like material whose needle penetration ranges from 10 to 100, and the overall space defined between said electronic timer and a wall of the cylinder is filled with a viscoelasticity material (319).

9. An electronic delay detonator including an electronic timer, and an electric detonator fired by ignition of an ignition element, said electronic timer comprising:

an energy charging circuit for storing electrical energy supplied from a power supply;

a delay circuit for determining a time period by using the electrical energy stored in said energy charging circuit to thereby output a trigger signal; and a first switching circuit for supplying the electrical energy stored in said energy charging circuit to said ignition element in response to the trigger signal, wherein said delay circuit comprises:

a first oscillator circuit using a characteristic frequency of a quartz oscillator as a reference;

a second oscillator circuit having a level of impact resistance greater than that of said first oscillator;

a count period producing circuit for producing one or a plurality of count periods by using pulses of said second oscillator circuit so that a count period coincides with a reference period produced by pulses of said first oscillator circuit; and a trigger signal generating circuit for generating and outputting said trigger signal based on said count period.

10. The electronic delay detonator as claimed in claim 9, wherein said trigger signal generating circuit comprises:

a reference pulse generator circuit (437) for generating a reference pulse signal based on said count period; and a main counter circuit (439) for outputting the trigger signal when said main counter circuit has counted the reference pulse signal by preset times.

11. The electronic delay detonator as claimed in claim 9, wherein said count period producing circuit comprises:

a circuit (423, 425) for generating a count period creation start signal and a count period creation end signal when said generating circuit has counted the pulse outputted from said first oscillator circuit (414) by first and second preset times; and a periodic counting data circuit (429) for starting the counting of the pulse outputted from said second oscillator circuit (435) upon receiving the count period creation start signal, terminating the counting of the output pulse of said second oscillator circuit upon receiving the count period creation end signal, and then fixing the result of the counting as a count period.

12. The electronic delay detonator as claimed in claim 9, wherein said count period producing circuit comprises:

means (451, 459, 472) for producing, as said reference period, first to nth (≧2) fixed time intervals whose minimum fixed time interval is equal to the minimum ignition time interval and which are predetermined and different from each other, using the pulse generated by said first oscillator circuit (414) as a reference, and means (453, 457, 473) for producing and latching the first to nth (≧2) count periods in accordance with the first to nth fixed time intervals using a pulse train generated by said second oscillator circuit as a reference, and wherein said trigger signal generating circuit comprises:

first to nth separating means (455, 461, 475) for respectively separating predetermined delay time intervals in reverse order by predetermined times in accordance with the first to nth count periods using a pulse train generated by said second oscillator circuit (435) as a reference; and means (467, 469, 477) for generating said trigger signal when the predetermined delay time intervals have been separated by the predetermined number of times at the first count period by said first separating means.

13. The electronic delay detonator as claimed in claim 12, wherein said first to nth fixed time interval producing means comprise:

a first fixed time interval producing counter (451) for counting a pulse train generated from said first oscillator circuit (414) during the first fixed time interval; and second through nth fixed time interval producing counters (459, 472) for respectively counting the pulse train generated from said first oscillator circuit during the second through nth fixed time intervals.

14. The electronic delay detonator as claimed in claim 12, wherein said first to nth separating means respectively comprise:

first to nth separating counters (455) which is set with first to nth count periods individually, said first to nth separating counters respectively counting the pulse train generated by said second oscillator circuit and outputting pulse signals each count-up time; and first to nth counters (461, 475) for counting pulses outputted from said first to nth separating counters each time said first to nth separating counters count up, said first to nth counters being activated in serial so as to release the (m−1)th counter from the reset state in response to the count-up of the mth (≦n ) counter.

15. An electronic delay detonator including an electronic timer (100), and an electric detonator (200) fired by ignition for an ignition element (221), said electronic timer characterized by comprising:

an energy charging circuit (120, 419) for storing electrical energy supplied from a power supply (10);

a delay circuit (30) for determining a time period by using the electrical energy stored in said energy charging circuit to thereby output a trigger signal; and a first switching circuit (140, 421) for supplying the electrical energy stored in said energy charging circuit to said ignition element in response to the trigger signal, and characterized in that said electronic timer comprises:

a malfunction detecting circuit (517, 153, 155, 151) for detecting a malfunction of circuit elements (511, 120), said malfunction occurring when the circuit element is subjected to an explosive shock, and said malfunction detecting circuit outputting a malfunction detecting signal;

a forced trigger circuit (157) for outputting a forced trigger signal in response to the malfunction detecting signal; and a second switching circuit (140) for supplying the ignition element (221) with the electrical energy stored in said energy charging circuit (120) in response to the forced trigger signal.

16. The electronic delay detonator as claimed in claim 15, wherein said malfunction detecting circuit comprises a quartz oscillator damage detecting circuit for detecting damage in the quartz oscillator.

17. The electronic delay detonator as claimed in claim 15, wherein said malfunction detecting circuit comprises a circuit (153, 155) for detecting a malfunction of said energy charging circuit (120).

18. The electronic delay detonator as claimed in claim 17, wherein said circuit for detecting a malfunction of said energy charging circuit (120) detects a voltage value of said energy charging circuit after completion of the charging of said energy charging circuit, and detects that the voltage value has reached the minimum firing voltage for firing said electric detonator (200).

19. The electronic delay detonator as claimed in claim 17, wherein said circuit for detecting a malfunction of said energy charging circuit (120) detects, after completion of the charging of said energy charging circuit, that a value of a discharge voltage vs. time gradient of said energy charging circuit is larger than a specific value.

20. The electronic delay detonator as claimed in claim 18, wherein said delay circuit comprises:

a first oscillator circuit using a characteristic frequency of a quartz oscillator as a reference;

a second oscillator circuit having a level of impact resistance greater than that of said first oscillator;

a count period producing circuit for producing one or a plurality of count periods by using pulses of said second oscillator circuit so that a count period coincides with a reference period produced by pulses of said first oscillator circuit; and a trigger signal generating circuit for generating and outputting a trigger signal based on the count period, and wherein said electric detonator is fired by ignition of an ignition element, said count period producing circuit comprises:

means for producing, as said reference period, first to nth (≧2) fixed time intervals whose minimum fixed time interval is equal to the minimum ignition time interval and which are predetermined and different from each other, using the pulse generated by said first oscillator circuit as a reference, and means for producing and latching the first to nth (≧2) count periods in accordance with the first to nth fixed time intervals using a pulse train generated by said second oscillator circuit as a reference, and wherein said trigger signal generating circuit comprises:

first to nth separating means for respectively separating predetermined delay time intervals in reverse order by predetermined times in accordance with the first to nth count periods using a pulse train generated by said second oscillator circuit as a reference; and means for generating said trigger signal when the predetermined delay time intervals have been separated by the predetermined number of times at the first count period by said first separating means.

21. The electronic delay detonator as claimed in claim 20, wherein said electric detonator (200) is fired by ignition of an ignition element (221), and to an impact externally applied to said electronic delay detonator, a lower limit of an impact value in an induced detonation range of said electric detonator substantially overlaps with an upper limit of an impact value in a range in which said electronic timer (100) is operable.

22. An electronic delay detonator including an electronic timer (100), and an electric detonator (200), fired by ignition of an ignition element (221), said electronic timer characterized by comprising:

an energy charging circuit (120, 419) for storing electrical energy supplied from a power supply (10);

a delay circuit (100) for determining a time period by using the electrical energy stored in said energy charging circuit to thereby output a trigger signal; and a first switching circuit (140, 421) for supplying the electrical energy stored in said energy charging circuit to said ignition element in response to the trigger signal, and characterized in that said electronic timer is housed within a cylinder (313) having impact resisting properties, and a space defined between said electronic timer and a wall of the cylinder is filled with a viscoelasticity material (319).

23. An electronic delay detonator including an electronic timer (100), and an electric detonator (200) fired by ignition of an ignition element (221), said electronic timer characterized by comprising:

an energy charging circuit (120, 419) for storing electrical energy supplied from a power supply (10);

a delay circuit (140, 421) for determining a time period by using the electrical energy stored in said energy charging circuit to thereby output a trigger signal; and a first switching circuit (140, 421) for supplying the electrical energy stored in said energy charging circuit to said ignition element in response to the trigger signal, and characterized in that said electronic timer is housed within a cylinder (313) having impact resisting properties, only a periphery of said energy charging circuit (120) is covered with one of a foamed resin and a gel-like material whose needle penetration ranges from 10 to 100, and an overall space defined between said electronic timer (100) and a wall of the cylinder is filled with a viscoelasticity material (319).

24. The electronic delay detonator as claimed in claim 23, wherein said viscoelasticity material contains 10 to 50% by volume a foaming agent.

25. The electronic delay detonator as claimed in claim 23, wherein said viscoelasticity material (319) has a hardness ranging from 10 to 90 under JIS Shore A durometer.

26. The electronic delay detonator as claimed in claim 22 or 23 wherein said cylinder is covered with a plastic case.

27. The electronic delay detonator as claimed in claim 22 or 23, wherein said electric detonator (200) shares an axis together with a cylinder (313) in which said electronic timer (100) is housed, and has a shape which is projected from said cylinder.

* * * * *